US005815995A

United States Patent [19]

Adam

[11] Patent Number: 5,815,995

[45] Date of Patent: Oct. 6, 1998

[54] SLIP-RESISTANT FLOOR COVERING SYSTEM

[75] Inventor: John M. Adam, Marietta, Ga.

[73] Assignee: Diversified Industrial Technologies, Inc., Marietta, Ga.

[21] Appl. No.: 691,750

[22] Filed: Aug. 1, 1996

Related U.S. Application Data

[60] Provisional application Nos. 60/009,772, Jan. 11, 1996, 60/009,773 Jan. 11, 1996, 60/009,774 Jan. 11, 1996, and 60/009,799 Jan. 11, 1996.

[51] Int. Cl.[6] ..... E04F 11/16

[52] U.S. Cl. ..... 52/177; 52/387; 52/392; 52/582.2; 15/215; 15/238

[58] Field of Search ..... 52/177, 179, 180, 52/181, 591, 403.1, 581, 582.2, 391, 392, 385, 387; 15/215, 238, 239; D12/203; D6/583

[56] References Cited

U.S. PATENT DOCUMENTS

| | | | |
|---|---|---|---|
| D. 11,972 | 9/1880 | Bourn . | |
| D. 16,297 | 9/1885 | Mankey . | |
| D. 171,936 | 4/1954 | Gates, Jr. | D6/583 |
| D. 179,858 | 3/1957 | Moor, Jr. | D9/6 |
| D. 181,977 | 1/1958 | Hirsch et al. | D12/203 |
| D. 196,365 | 9/1963 | Sheehan | D18/2 |
| D. 313,789 | 1/1991 | Thundercloud | D12/203 |
| D. 336,341 | 6/1993 | Van Steenlandt | D25/58 |
| 1,625,187 | 4/1927 | Birch | 52/177 |
| 2,026,224 | 12/1935 | Drehmann | 94/11 |
| 2,108,226 | 2/1938 | Johnston | 94/3 |
| 2,337,156 | 12/1943 | Elmendorf | 20/8 |
| 2,512,310 | 6/1950 | Corson | 15/215 |
| 3,206,785 | 9/1965 | Heil | 15/215 |
| 4,045,927 | 9/1977 | Diaz | 403/292 X |
| 4,497,858 | 2/1985 | Dupont et al. | 428/44 |
| 4,654,245 | 3/1987 | Blazer et al. | 52/177 X |
| 5,154,961 | 10/1992 | Reuben | D12/203 X |
| 5,190,799 | 3/1993 | Ellingson, III | 52/180 X |

FOREIGN PATENT DOCUMENTS 382049 10/1888 United Kingdom .

OTHER PUBLICATIONS

Consolidated Plastics Co., Inc.—Commercial Floor Mats & Matting Catalog—1994 —pp. 10, 11 & 12 —Gripper "No–Slip" & Rib Mats.

*Primary Examiner*—Winnie S. Yip
*Attorney, Agent, or Firm*—Isaf, Vaughan & Kerr

[57] ABSTRACT

A slip-resistant floor covering system comprising, in accordance with preferred embodiments of apparatus of the present invention, a slip-resistant tile having a plurality of pyramidal-shaped ridges which support an individual's foot at an elevation above liquid and other slip-inducing substances which flow through a network of drainage troughs (each trough being defined between adjacent ridges) and channels in the upper surface of the tile. The ridges of the plurality of ridges are directionally oriented relative to the channels to encourage rapid flow of spilled liquid and other substances away from a spill site. The orientation of the ridges relative to the channels also induces air flow through the troughs and channels in order to reduce foot and leg fatigue which may be experienced by an individual standing on the tile for long periods of time. Protruding members, extending from the lower surface of the tile, contact a floor surface and limit relative movement between the tile and the floor surface. Anti-bacterial and anti-fungal agents, impregnated into the material of the tile, reduce the growth of bacteria and fungi in and around the tile. In a first preferred embodiment of the apparatus, the system includes a plurality of cavities, passageways, and bores defined by the base and lower surface of the tile. In accordance with a preferred embodiment of a method of the present invention, pluralities of clips and pins received by respective pluralities of adjacent cavities, passageways, and bores of adjacent tiles, secure adjacent tiles together in an assembly which is tailorable, at the time of installation, to cover a desired area of floor surface.

12 Claims, 18 Drawing Sheets

Fig. 4A
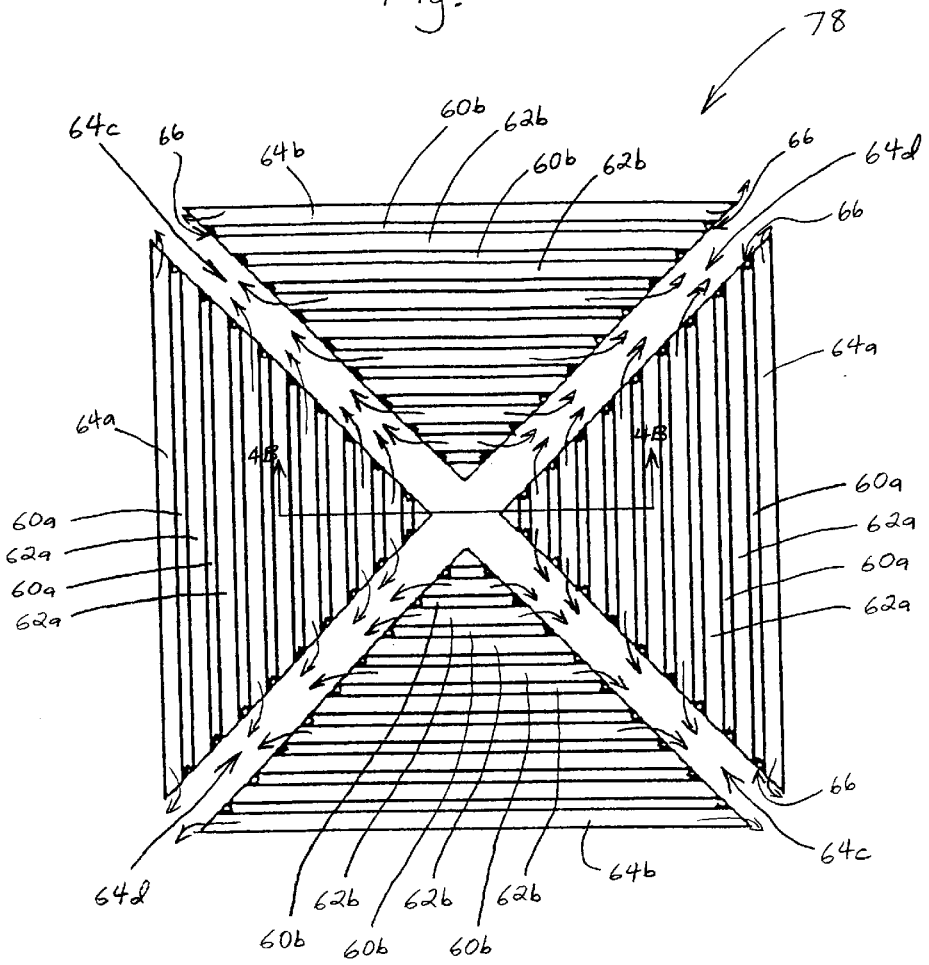
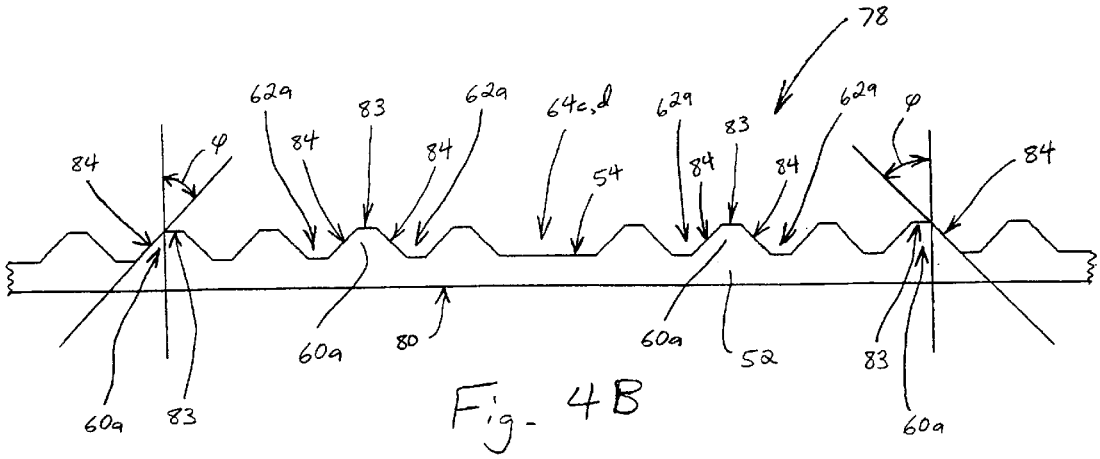
Fig. 4B

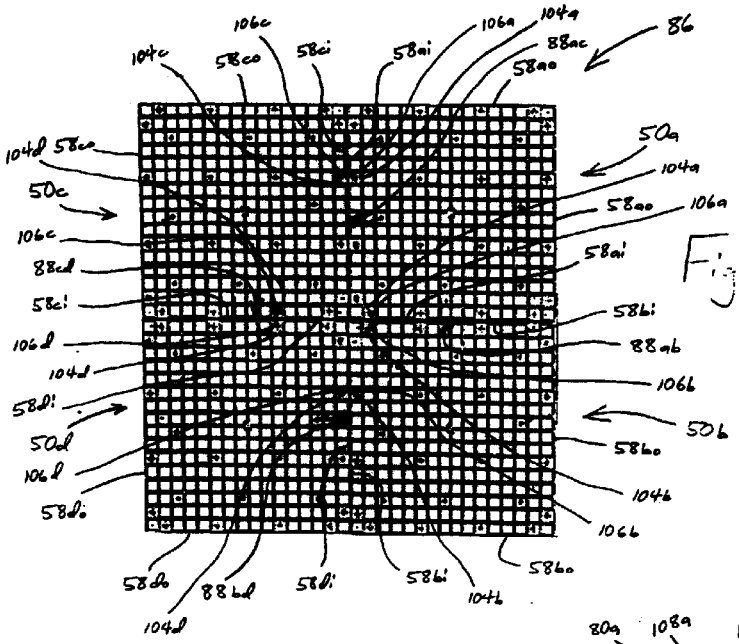
Fig. 10A
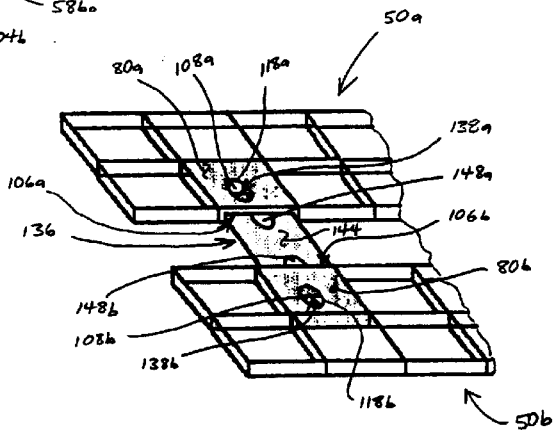
Fig. 10B
Fig. 10C
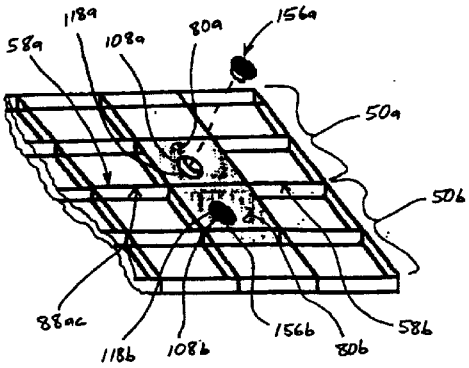

Fig. 16A
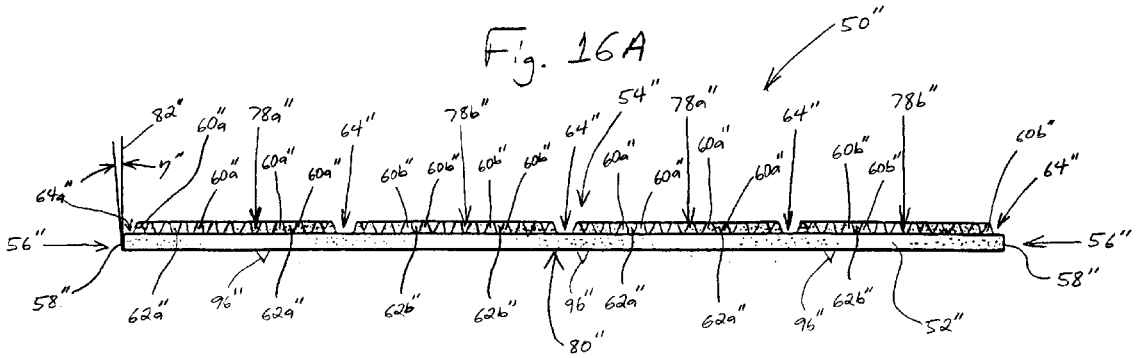
Fig. 16B
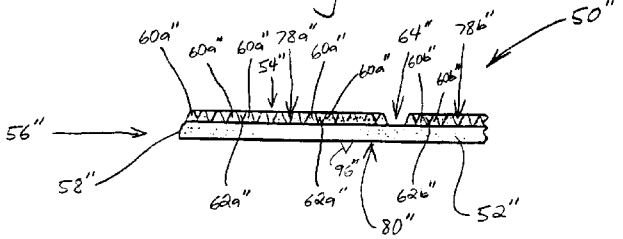
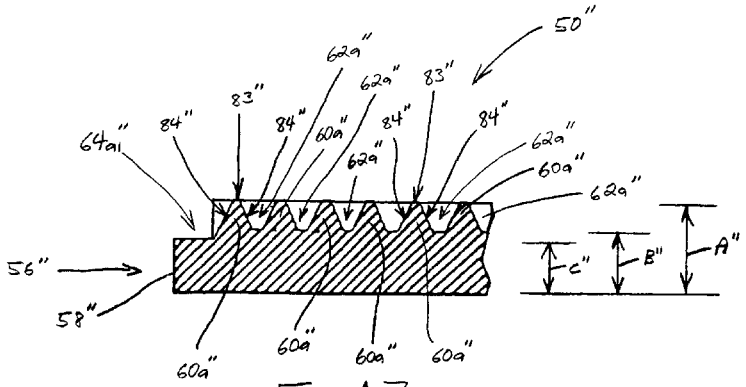
Fig. 17

SLIP-RESISTANT FLOOR COVERING SYSTEM

CROSS REFERENCE TO RELATED APPLICATIONS

This application is a continuation, of application Ser. No. 60/009,772, filed on Jan. 11, 1996, of application Ser. No. 60/009,773, filed on Jan. 11, 1996, of application Ser. No. 60/009,774, filed on Jan. 11, 1996, of application Ser. No. 60/009,799, filed on Jan. 11, 1996.

BACKGROUND OF THE INVENTION

This invention relates generally to the field of floor coverings, and in its preferred embodiments, to slip resistant floor coverings for application in pre-determined hazardous areas.

Slippery and unsafe floor surfaces create a substantial risk of injury to pedestrians who walk on such surfaces while at work and/or at leisure. A fall on a slippery surface may result in broken bones and soft tissue injuries to an individual, with the potential for long term disabilities, lost work time, lost revenues and income, and resultant societal issues of medical costs and insurance and legal actions.

Slippery floor surfaces may be found in a variety of locations, including public buildings, commercial establishments, and industrial plants. Typically, a slippery floor surface is created when water, grease, and/or other substances are spilled on an area of a floor, fail to drain properly away from the area, and collect. Due to physical properties inherent to the substances, the collected substances reduce the coefficient of friction normally present between an individual's shoe and the floor at the site of the spill, thereby establishing a slippery spot on the floor where shoe traction is significantly reduced over its ordinary level. Locations which are prone to producing slippery floor surfaces generally include restaurant kitchens and service areas, customer self-help areas at convenient stores and gas stations, wet therapy areas of medical facilities, areas near building entrances or exits, and areas found under leaky pipes and/or equipment. In addition to creating a slippery spot on the floor, the collected substances may, depending on their nature, create a breeding ground for bacteria, fungi, and other health hazards.

Historically, various types of floor coverings, including mats, ribbed rugs, and wooden slatted platforms, have been employed in an effort to eliminate slippery surfaces and, hence, deter people from slipping and/or falling. Unfortunately, among other shortcomings, such coverings are often unavailable in a size which is appropriate for a particular area of floor surface and, as a result, one or more smaller coverings must be joined together to adequately cover an area. While, perhaps, reducing the risk of an individual slipping or falling, seams between the coverings, produced by a joining process, create an additional hazard because individuals may trip over an improperly formed seam while traversing the covering. Additionally, such seams often come apart and an individual may trip over an exposed internal edge of a covering or, more frequently, an individual may trip over a blunt, exposed, outer perimeter edge of such coverings. Certain coverings, such as mats and ribbed rugs, are also susceptible to creeping across or moving relative to a floor surface in response to constant foot traffic, thereby exposing a slippery area of the floor surface which was supposed to be covered by the mat or ribbed rug.

There is, therefore, a need in the industry for a floor covering system which effectively and efficiently diminishes the probability of slip and fall mishaps by producing secure footing in otherwise hazardous areas and can solve other related and unrelated problems that become apparent upon reading and understanding this specification.

SUMMARY OF THE INVENTION

Briefly described, the present invention includes a slip-resistant floor covering apparatus and method which reduce the risk that an individual may slip and/or fall on a slippery floor surface by supporting the individual's foot at an elevation above that of liquids and/or other potentially slip-inducing substances. More particularly, the present invention includes a slip-resistant floor covering apparatus and method which employ a slip-resistant tile having unique arrangements of foot-supporting ridges and liquid-collecting troughs, interposed between adjacent ridges, which are in fluid communication with strategically located drainage channels to enable proper removal of liquids and/or other potentially slip-inducing substances from a site of a spill.

In accordance with the preferred embodiments of the apparatus of the present invention, the slip-resistant floor covering comprises a slip-resistant tile having a base with an upper surface defined by a plurality of ridges, each having a unique truncated-pyramidal design, in a unique arrangement to support a foot at an elevation above a drainage network which includes a plurality of troughs extending between adjacent ridges and a plurality of channels in fluid communication with each trough. The plurality of ridges comprises a first plurality of ridges and a second plurality of ridges which extend between channels of the plurality of channels, thereby placing their associated first and second pluralities of troughs in fluid communication with the channels and enabling spilled liquid to properly drain away from a site of a spill by flowing from the troughs and into the channels for direction toward a side of the slip-resistant tile. The ridges of the first and second pluralities of ridges and, hence, the troughs of the first and second pluralities of troughs, extend in different directions (preferably, perpendicular directions) in order to induce spilled liquids to flow into different channels of the plurality of channels, reducing the chance that a single channel may become overfilled with liquid, and, therefore, enhancing drainage of liquid from the site of a spill The same arrangement of ridges, troughs, and channels also enables air to flow between the troughs and channels, in response to a foot forcing air into non-liquid filled troughs and channels, thereby decreasing foot and leg fatigue which might, otherwise, occur if such air flow were not enabled by the slip-resistant tile.

The pluralities of ridges, troughs, and channels are also arranged in a plurality of cells which add an aesthetic appeal to the slip-resistant tile while defining multiple drainage paths for spilled liquid. The slip-resistant tile is, preferably, manufactured from a durable material impregnated with anti-bacterial and anti-fungal agents which reduce the growth of bacteria and fungi in liquid residue that may remain on surfaces of the troughs and channels. In addition, the upper surface of the slip-resistant tile, including the pluralities of ridges, troughs, and channels, is finely polished to decrease adherence of liquids, debris, and other substances to the tile, thereby improving the drainage capability of the slip-resistant tile and further reducing the opportunistic growth of bacteria and fungi The lower (under) surface of a preferred embodiment of the slip-resistant tile defines a plurality of ribs, extending in a row and column grid between opposite sides of the tile, and a plurality of recesses between a substantial portion of the adjacent row and column ribs. A plurality of protruding members depend from a number of the recesses to contact an underlying floor surface. The protruding members enable the slip-resistant tile to maintain sufficient contact with the underlying floor surface in order to keep the tile from moving, or creeping, relative to the floor surface, while the recesses trap air beneath the tile and, thereby provide a cushioning effect which deters leg and/or foot fatigue. The recesses also reduce the quantity of material required to manufacture the tile, thereby reducing the weight and production cost of the tile. Edges of the slip-resistant tile, extending between the upper and lower surfaces, are beveled if the edges are not adjacent to similarly disposed edges of adjacent tiles, thereby decreasing the likelihood that an individual might trip over an edge of the tile.

In accordance with the first preferred embodiment of an apparatus of the present invention, the base and its lower surface define a plurality of cavities strategically located adjacent to edges of the slip-resistant tile, and when the tile between adjacent ribs of the row and column grid of ribs. The base further defines a plurality of passageways, each passageway extending through an edge of the tile adjacent to the location of a cavity to enable receipt of a clip, by the cavity, upon insertion of the clip through the passageway. A plurality of bores, also defined by the base, extend into the base from an opening in the lower surface of the slip-resistant tile, each bore intersecting a cavity and including a tapered portion which securedly engages a tapered portion of a pin received by the bore. The tapered portions of the bores and pins are engineered to prevent contact of the pin with an underlying floor surface when the slip-resistant tile is placed upon a floor. The clip, one of a plurality of clips employed to enable creation of a modular slip-resistant floor covering from a plurality of adjacent slip-resistant tiles, is sized to have a first end receivable by a cavity of a first tile and a second end receivable, at the same instant, by a cavity of an abutting, adjacent tile. Holes, defined near each end of the clip, extend between upper and lower surfaces of the clip and are alignable, with a bore associated with a cavity, for receipt of a pin. The unique interaction of the cavities, bores, clips, and pins of the present invention enables sizing and shaping of a modular slip-resistant floor covering through incorporation and positioning of an appropriate number of tiles to fit a desired area of a floor.

An assembly of slip-resistant tiles is created, in accordance with a preferred embodiment of a method of the present invention, by placing tiles on a sturdy flat surface with their lower surfaces facing upward. The slip-resistant tiles are oriented in an arrangement necessary to fit a desired floorspace and are aligned with one or more passageways of each tile being adjacent to one or more similarly disposed passageways of an adjacent tile. After alignment of the tiles is complete, an appropriate number of clips are partially received within opposing passageways and cavities of adjacent tiles so that the holes of each clip are aligned with the bores associated with the clip-receiving cavities. An appropriate number of pins are then received by the bores of the tiles and the holes of the clips to secure the clips within the cavities of the adjacent tiles, thereby securing the adjacent tiles together in a manner that creates an assembly of tiles having an even, continuous upper surface with substantially level seams between tiles. Once all necessary chips and pins are received by the appropriate tiles, the assembly of slip-resistant tiles is rotated to expose the upper surfaces of the tiles and the assembly is positioned to cover a desired area of a floor's surface.

Accordingly, it is an object of the present invention to reduce the risk that an individual might slip and/or fail on a slippery floor surface.

Another object of the present invention is to elevate an individual's foot bottom above liquid and/or other potentially slip-inducing substances.

Still another object of the present invention is to reduce pooling of liquid and/or other potentially slippery substances by enabling them to drain away properly from the site of a spill.

Still another object of the present invention is to direct liquid from the site of a spill into different channels to encourage drainage.

Still another object of the present invention is to aid in eliminating breeding grounds for bacteria, fungi, and other health hazards.

Still another object of the present invention is to reduce foot and leg fatigue.

Still another object of the present invention is to enable sizing of a slip-resistant floor covering, at the time of installation, to properly cover a desired area.

Still another object of the present invention is to reduce the likelihood that an individual may trip over a seam between slip-resistant floor coverings.

Still another object of the present invention is to provide a modular slip-resistant floor covering which is easy to assemble.

Still another object of the present invention is to join slip-resistant floor coverings with clips and pins.

Still another object of the present invention is to decrease relative movement between a slip-resistant floor covering and a floor surface.

Still another object of the present invention is to reduce the likelihood that an individual might trip over an exposed edge of a slip-resistant covering.

Still another object of the present invention is to provide a slip-resistant floor covering having an aesthetically appealing design.

Other objects, features, and advantages of the present invention will become apparent upon reading and understanding the present specification when taken in conjunction with the appended drawings.

BRIEF DESCRIPTION OF THE DRAWINGS

FIG. 4A is a top, plan view of a single cell of the slip-resistant tile of FIG. 1.

FIG. 4B is a partial, sectional view of the single cell of the slip-resistant tile of FIG. 4A take along lines 4B—4B.

FIG. 10A is a bottom, plan, pictorial view of the assembly of slip-resistant tiles of FIG. 5, in accordance with a preferred embodiment of a method of the present invention or to assembly.

FIG. 10B is a partial, bottom, perspective, pictorial view of the assembly of slip-resistant tile of FIG. 10A during installation of a plurality of clips.

FIG. 10C is a partial, bottom, perspective, pictorial view of the assembly of slip-resistant tiles of FIG. 10B after installation of a plurality of clips and during installation of a plurality of pins.

FIG. 16A is a side elevational view of the slip-resistant tile of FIG. 15.

FIG. 16B is a partial, side elevational view of a slip-resistant tile having a beveled edge in accordance with the third preferred embodiment of the apparatus of the present invention.

FIG. 17 is a partial, sectional view of the slip-resistant tile of FIG. 15 taken along lines 17—17.

DETAILED DESCRIPTION OF THE PREFERRED EMBODIMENTS

Figure 1:
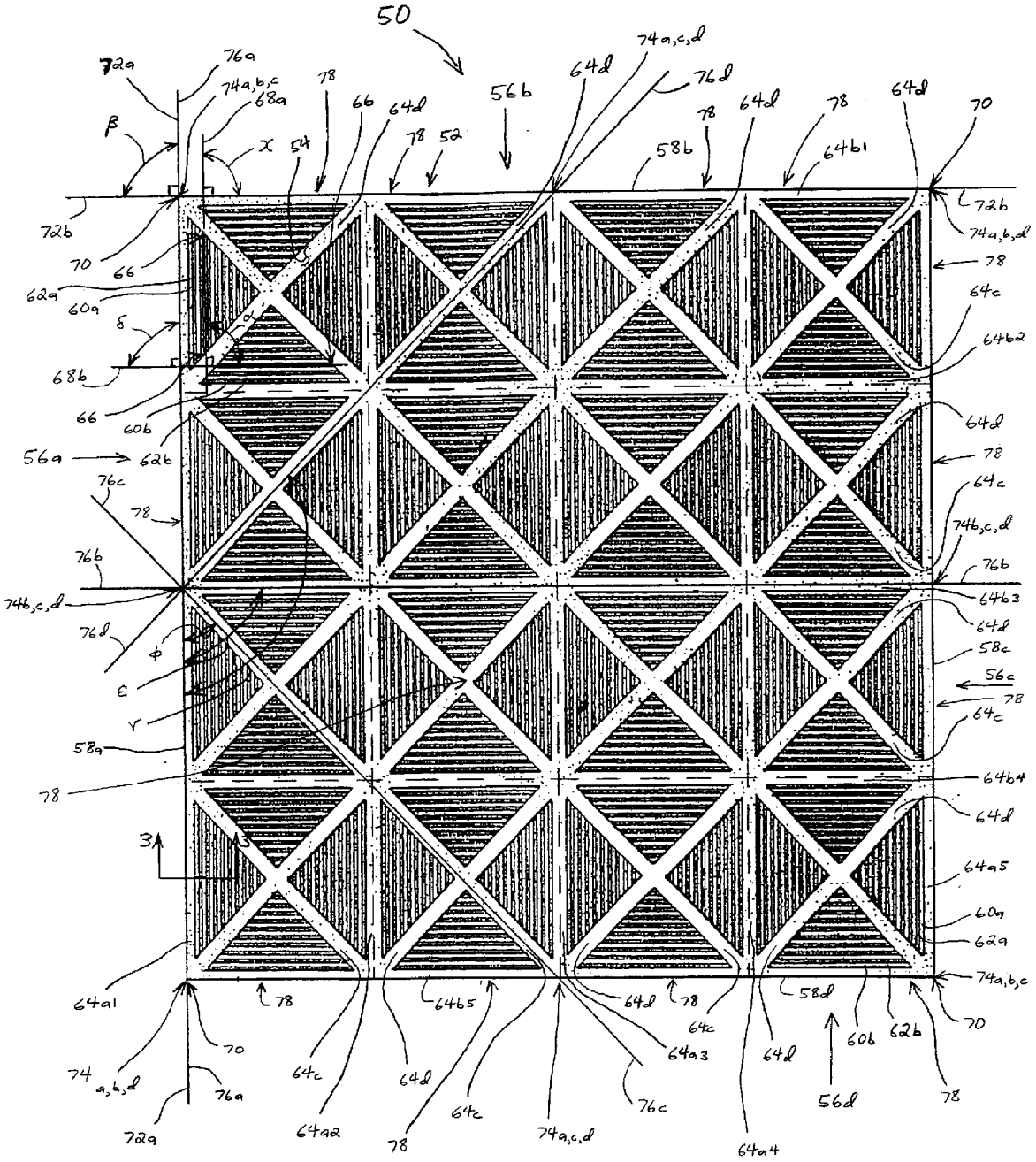
FIG. 1 is a top, plan view of a slip-resistant tile in accordance with a first preferred embodiment of an apparatus of the present invention.

Referring now to the drawings, in which like numerals represent like components throughout the several views, FIG. 1 displays a slip-resistant tile 50 in accordance with a preferred embodiment of an apparatus of the present invention. The slip-resistant tile 50 comprises a base 52 having an upper surface 54 and sides 56 (side 56*a* being disposed opposite side 56*c* and side 56*b* being disposed opposite side 56*d*) with edges 58. A plurality of ridges 60 and a plurality of troughs 62, which are defined between adjacent ridges of the plurality of ridges 60, partially define the upper surface 54. A plurality of channels 64 extend between two sides 56 of the base 52 and, in conjunction with the pluralities of ridges and troughs 60,62, define the upper surface 54 of the base 52. In accordance with the preferred embodiment of the apparatus of the present invention, the slip-resistant tile 50 is manufactured from flexible polyvinyl chloride (PVC) 202UV-83 containing a plurality of performance enhancement additives including, for example and not limitation, ultraviolet inhibitors, anti-fungals, anti-microbials, anti-oxidants, anti-ozonants, powdered clay filler, and artificial coloring agents. Preferably, the upper surface 54, including each ridge 60, trough 62, and channel 64, is finely polished to enhance water deflection and to eliminate, macroscopically and microscopically, rough surfaces to which grease, debris, or oils may attach and accumulate.

Each ridge 60 of the plurality of ridges 60 and each trough 62 of the plurality of troughs 62, in accordance with the preferred embodiments of the apparatus of the present invention, extends between two channels 64 of the plurality of channels 64, thereby placing each trough 62 of the plurality of troughs 62 in fluid communication with at least two channels 64 and allowing any fluid or debris collected by a trough 62 to flow into a channel 64 and away from the location at which it came into contact with the slip-resistant tile 50. Each ridge 60 of the plurality of ridges 60 has ends 66 which define an axis 68 extending therethrough. The plurality of ridges 60 includes a first plurality of ridges 60*a* defining a first plurality of axes 68*a* and a second plurality of ridges 60*b* defining a second plurality of axes 68*b*. Note that only one axis 68 of each of the first and second pluralities of axes 68*a,b* is depicted in order to avoid unnecessary cluttering of FIG. 1. Each axis 68*a* of the first plurality of axes 68*a* and each axis 68*b* of the second plurality of axes 68*b* define an angle, $\alpha$, therebetween which, in accordance with the preferred embodiments of the apparatus of the present invention, measures ninety degrees. As seen in FIG. 1, edges 58*a,b* have ends 70 which define axes 72*a,b* extending therethrough. Axis 72*a* and axis 72*b* (and, therefore, sides 56*a,b*) define an angle, $\beta$, therebetween which, preferably, measures ninety degrees. Each axis 68*a* of the first plurality of axes 68*a* defines an angle, $\chi$, with axis 72*b* and each axis 68*b* of the second plurality of axes 68*b* defines an angle, $\delta$, with axis 72*a*. In accordance with the first preferred embodiment of the apparatus of the present invention, angles $\chi$ and $\delta$ measure ninety degrees and, therefore, each ridge 60*a* of the first plurality of ridges 60*a* extends in a direction perpendicular to side 56*b* (and parallel to side 56*a* (and each ridge 60*b* of the second plurality of ridges 60*b* extends in a direction perpendicular to side 56*a* (and parallel to side 56*b*). It is understood that other measures of angles $\alpha$,$\beta$,$\chi$, and $\delta$ are considered within the scope of the present invention.

Each channel 64 of the plurality of channels 64, in accordance with the preferred embodiments of the apparatus of the present invention, extends between at least two sides 56. The plurality of channels 64, as shown in FIG. 1, includes a first plurality of channels 64*a*, a second plurality of channels 64*b*, a third plurality of channels 64*c*, and a fourth plurality of channels 64*d*. Each channel 64*a* of the first plurality of channels 64*a* extends between sides 56*b,d* adjacent to (and between) ridges of the first plurality of ridges 60*a* and has ends 74*a* which define an axis 76*a* therebetween (note that each channel 64*a* defines an axis 76*a* and that only one axis 76*a* is displayed to avoid cluttering FIG. 1, that each axis 76*a* extends parallel to each other axis 76*a*, and that each channel 64*a* extends parallel to each other channel 64*a* of the first plurality of channels 64*a*). Channels 64*a*1,*a*5 also extend adjacent sides 56*a,c*, respectively. Each axis 76*a* extends parallel to axis 72*a* and, hence, the channels 64*a* of the first plurality of channels 64*a* extend parallel to sides 56*a,c*. Each channel 64*b* of the second plurality of channels 64*b* extends between sides 56*a,c* adjacent to (and between) ridges of the second plurality of ridges 60*b* and has ends 74*b* which define an axis 76*b* therebetween (note that each channel 64*b* defines an axis 76*a* and that only one axis 76*b* is displayed to avoid cluttering FIG. 1, that each axis 76*b* extends parallel to each other axis 76*b*, and that each channel 64*b* extends parallel to each other channel 64*b* of the second plurality of channels 64*b*). Channels 64*b*1,*b*5 also extend adjacent sides 56*b,d*, respectively, and intersect channels 64*a*1,64*a*5. Each axis 76*b* defines an angle, $\epsilon$, with axis 72*a*. In accordance with the preferred embodiments of the present invention, angles, $\epsilon$, measure ninety degrees and, therefore, the channels 64*b* of the second plurality of channels 64*b* extend parallel to sides 56*b,d* (and perpendicular to sides 56*a,c*).

Each channel 64*c* of the third plurality of channels 64*c*, as seen in FIG. 1, extends between ridges 60 of the first and second pluralities of ridges 60*a,b* and has ends 74*c* which define an axis 76*c* therebetween (note that each channel 64*c* defines an axis 76*c* and that only one axis 76*c* is displayed to avoid cluttering FIG. 1, that each axis 76*c* extends parallel to each other axis 76*c*, and that each channel 64*c* extends parallel to each other channel 64*c* of the third plurality of channels 64*c*). Each axis 76*c* and axis 72*a* define an angle, $\phi$, therebetween with each angle, $\phi$, measuring forty-five degrees in accordance with the first preferred embodiment of the apparatus of the present invention. Each channel 64*d* of the fourth plurality of channels 64*d* extends between ridges 60 of the first and second pluralities of ridges 60*a,b* and has ends 74*d* which define an axis 76*d* therebetween (note that each channel 64*d* defines an axis 76*d* and that only one axis 76*d* is displayed to avoid cluttering FIG. 1, that each axis 76*d* extends parallel to each other axis 76*d*, and that each channel 64*d* extends parallel to each other channel 64*d* of the fourth plurality of channels 64*d*). Each axis 76*d* and axis 72*a* define an angle, $\gamma$, therebetween with each angle, $\gamma$, measuring one hundred thirty-five degrees in accordance with the first preferred embodiment of the apparatus of the present invention. Note that each channel 64 of a plurality of channels 64 intersects at least one channel 64 of each of the other pluralities of channels 64, thereby placing each channel 64 of the pluralities of channels 64 in fluid communication with at least one other channel 64 of the pluralities of channels 64 and enabling fluid to flow from one channel 64 to another channel 64.

In accordance with the preferred embodiments of the apparatus of the present invention, the arrangement of the plurality of ridges 60 and associated plurality of troughs 62 defines a plurality of cells 78 (shown in FIG. 1 using dashed lines to indicate cell boundaries) with each cell 78 (see FIG. 4A) including portions of channels 64 of the first and second pluralities of channels 64*a,b* which separate the cell 78 from an adjacent cell 78. Preferably, each cell 78 has a, generally, square shape with each side measuring three inches long, thereby defining the slip-resistant tile 50 as having a, generally, square shape with each side 56 measuring twelve inches in length. It is understood that the scope of the present invention includes cells having other shapes and measures, as well as tiles having other shapes and measures. In accordance with the first preferred embodiment of the apparatus of the present invention, each cell 78 includes ridges 60*a* of the first plurality of ridges 60*a* (and troughs 62*a* of the associated first plurality of troughs 62*a*) and ridges 60*b* of the second plurality of ridges 60*b* (and troughs 62*b* of the associated second plurality of troughs 62*b*). The first and second pluralities of ridges 60*a,b* (and associated first and second pluralities of troughs 62*a,b*) are each arranged as, generally, triangular-shaped regions within each cell 78. A channel 64*c* of the third plurality of channels 64*c* and a channel 64*d* of the fourth plurality of channels 64*d* extend diagonally through each cell 78 and intersect at the middle, separating the first and second pluralities of ridges 60*a,b* (and their respective associated first and second pluralities of troughs 62*a,b*).

Figure 2A:
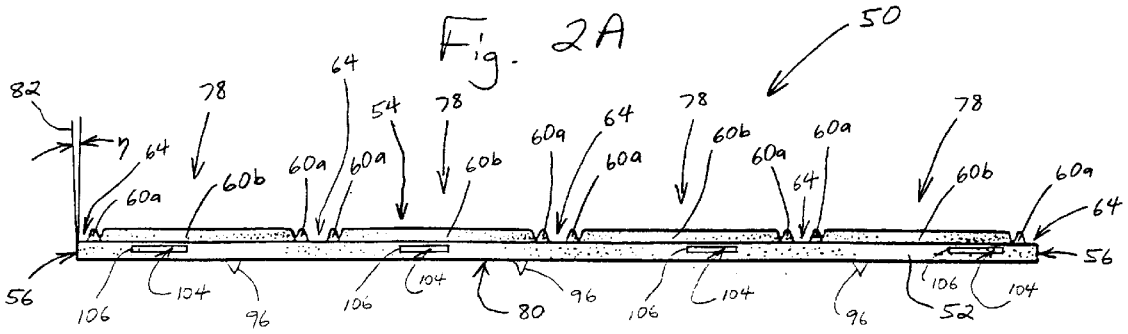
FIG. 2A is a side elevational view of the slip-resistant tile of FIG. 1.
Figure 2B:
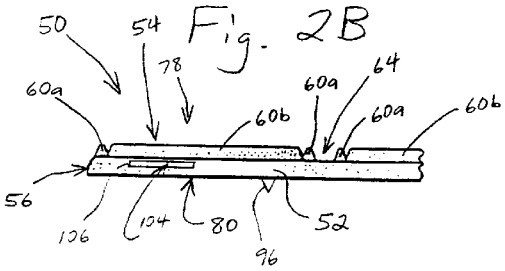
FIG. 2B is a partial side elevational view of a slip-resistant tile having a beveled edge in accordance with the first preferred embodiment of the apparatus of the present invention.
Figure 5:
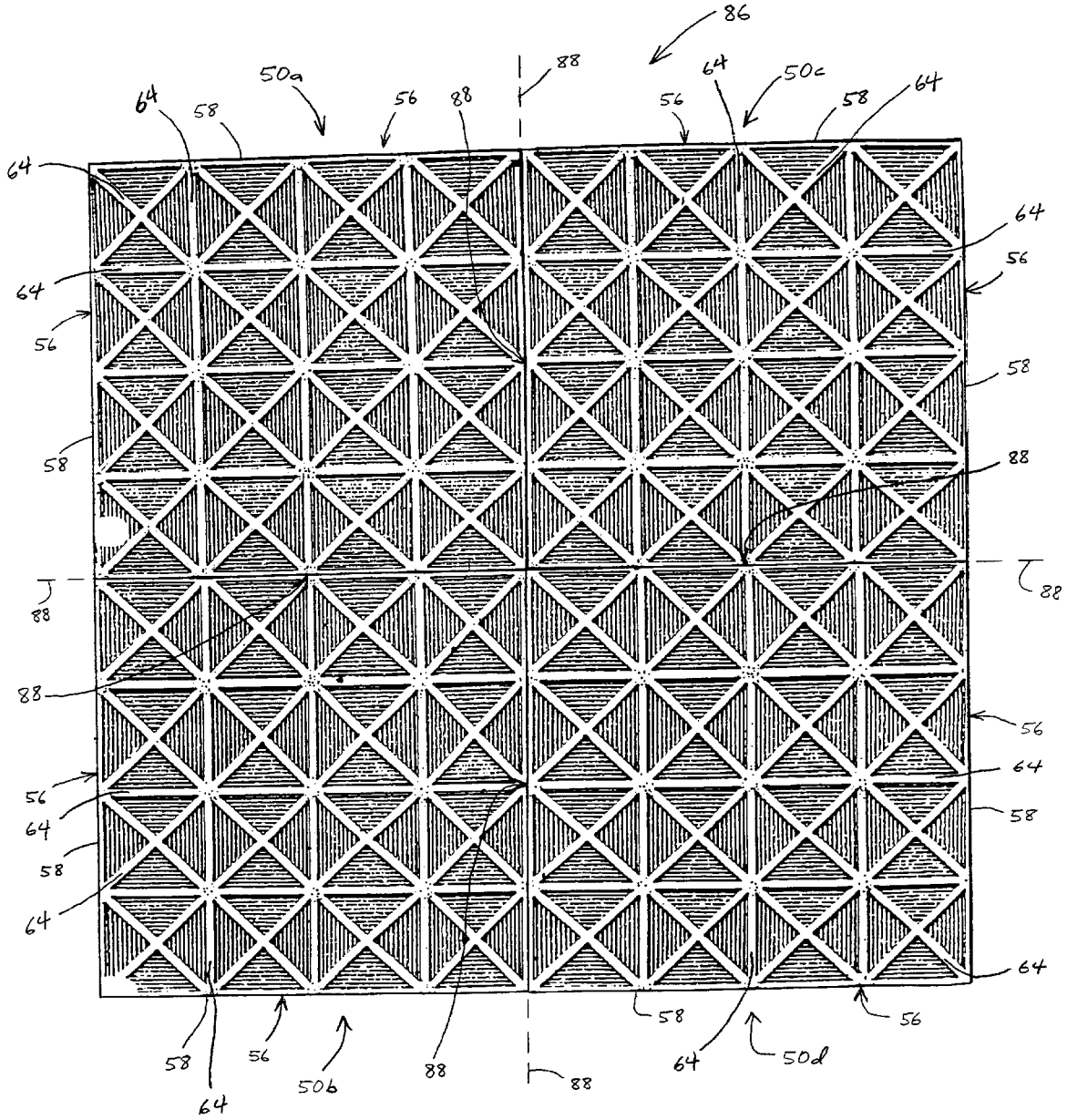
FIG. 5 is a top, plan view of an assembly of slip-resistant tiles in accordance with he first preferred embodiment of the apparatus of the present invention.

FIG. 2A displays a side elevational view of a slip-resistant tile 50, in accordance with the first preferred embodiment of the apparatus of the present invention, and, more particularly, displays a plurality of adjacent cells 78, each including ridges 60 of the first and second pluralities of ridges 60*a,b* and channels 64 of the plurality of channels 64. The base 52 further includes a lower surface 80 disposed below the upper surface 54. Note that FIG. 2A also shows a slip-resistant tile 50 having an edge 56 which, when assembled with other slip-resistant tiles 50 in an assembly as seen in FIG. 5, abuts a similar edge 56 of another slip-resistant tile 50. The abutting edges 56 of the slip-resistant tiles 50 are referred to as "inside" edges and, in order to improve contact between slip-resistant tiles 50 of the assembly of FIG. 5, each inside edge 56 defines an angle, $\eta$, with respect to a vertical axis 82 measuring, preferably, two degrees. FIG. 2B illustrates a partial, side elevational view of a slip-resistant tile 50 having an edge 56 which, when assembled with other slip-resistant tiles 50 in the assembly of FIG. 5, partially defines the outer perimeter of the assembly and is, therefore, known as an "outside" edge 56. Note that outside edge 56 is, preferably, substantially beveled in order to reduce the risk of tripping to an individual who, if the outside edge 56 were not beveled, might catch a shoe on the outside edge 56 and, subsequently, trip over the outside edge 56.

Figure 3:
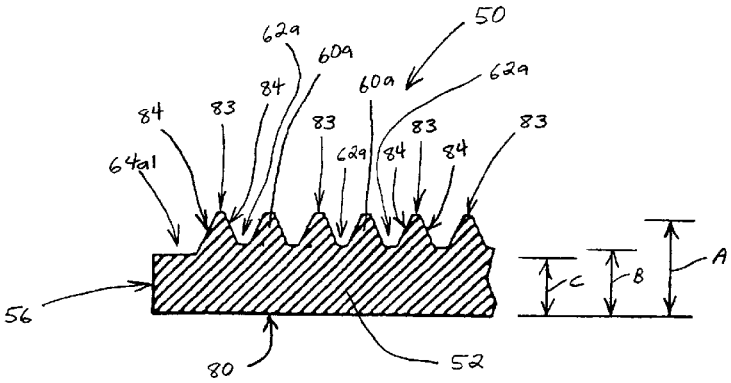
FIG. 3 is a partial, sectional view of the slip-resistant tile of FIG. 1 taken along lines 3—3.

FIG. 3 displays a partial, sectional view of a slip-resistant tile 50 and shows a first plurality of ridges 60*a* protruding from the base 52 and extending to an elevation, "A", relative to the lower surface 80. The portion of the upper surface 54 extending between each ridge 60*a* (and defining the lowest extent of troughs 62*a*) has an elevation, "B", with respect to the lower surface 80, while the portion of the upper surface 54 defined by the channel 64*a*1 has an elevation, "C", with respect to the lower surface 80. In accordance with the preferred embodiments of the apparatus of the present invention and as seen in FIG. 3, elevation "A" is greater than elevation "B" and elevation "B" is greater than elevation "C". Because elevation "A" is greater than elevation "B", the first plurality of ridges 60*a* support a foot of an individual walking on the slip-resistant tile 50 at an elevation higher than the lowest extent of a trough 62*a*, thereby raising the bottom of the individual's foot above any liquid or other debris that may be accumulated and/or flowing in a trough 62*a*. Additionally, by supporting the individual's foot at a higher elevation than the lowest extent of a trough 62*a*, a certain amount of air is pushed through the trough 62*a* in response to the individual's foot contacting the ridges 60*a*, thereby reducing foot and leg fatigue which might, otherwise, result from walking on the slip-resistant tile 50. Because elevation "B" is greater than elevation "C", liquid and other debris flowing within a trough 62*a* naturally flows, due to the force of gravity, from the lowest extent of each trough 62*a* into a channel 64, thereby providing improved drainage capability over a tile in which the lowest extent of a trough is at the same elevation as a channel. Note that the relationship of the first plurality of ridges 60*a*, the first plurality of troughs 62*a*, the channel 64*a*1, and the associated elevations pictured in FIG. 3 are representative of and substantially similar to the relationship of the second plurality of ridges 60*b*, the second plurality of troughs 62*a*, the other channels 64 of the plurality of channels 64, and their associated elevations which comprise other regions of the slip-resistant tile 50.

An individual cell 78 of the plurality of cells 78 is shown more clearly by FIG. 4A. Note that the cell 78 includes portions of channels 64*a,b* which establish the boundaries of the cell 78 and channels 64*c,d* which extend diagonally through the cell 78, intersecting at the cell's midpoint and intersecting channels 64*a,b* near the cell's perimeter. The first and second pluralities of ridges 60*a,b* are separated by channels 64*c,d* and the first and second pluralities of troughs 62*a,b* fluidically communicate with channels 64*c,d*, as indicated by the arrows, to remove liquid and/or other debris from troughs 62*a,b*. Channels 64*c,d* fluidically communicate with channels 64*a,b*, as illustrated by the arrows, to remove liquid and/or other debris from the slip-resistant tile 50.

The pluralities of ridges 60*a* and the plurality of troughs 62*a* which partially define the upper surface 54 of the cell 78 of FIG. 4A are shown in the sectional view of FIG. 4B. Each ridge 60*a* comprises a top surface 83 and lateral surfaces 84 which slope downward from the top surface 83 and toward the lower surface 80. The top surface 83 extends between the ridge's ends 66 and is, preferably, a horizontal surface. Each lateral surface 84 also extends between the ridge's ends 66 and defines an angle, $\phi$, with respect to a vertical plane as shown by the sample angles, $\phi$, illustrated in FIG. 4B. In accordance with the preferred embodiments of the apparatus of the present invention, each angle, $\phi$, measures forty-five degrees. As seen in FIG. 4B, the lateral surfaces 84 of adjacent ridges 60 define the horizontal extent of a trough 62*a* and a portion of the upper surface 54 extending between the lateral surfaces 84 of adjacent ridges 60*a* defines the lowest, or vertical, extent of a trough 62*a*. FIG. 4B also displays the region of the upper surface 54 of the base 52 defined by the intersection of channels 64*c,d*. Note that the configuration of all ridges 60 and troughs 62 is substantially identical to the configuration of the pluralities of ridges 60*a* and troughs 62*a* shown in FIG. 4B. It is understood that the scope of the present invention encompasses ridges having different shapes and angles, $\phi$, having different measures.

FIG. 5 displays an assembly 86 of a plurality of slip-resistant tiles 50*a,b,c,d,* in accordance with the first preferred embodiment of the apparatus of the present invention, and shows a plurality of seams 88 which are defined between adjacent slip-resistant tiles 50. Note that while FIG. 5 displays an assembly 86 comprising only four slip-resistant tiles 50, it is understood that an assembly 86 of slip-resistant tiles 50 may include as many tiles 50 as necessary to cover a desired area of floor surface. Note also that, as illustrated by FIG. 5, many channels 64 of the pluralities of channels 64 of a slip-resistant tile 50 abut and interact with similarly disposed channels 64 of the pluralities of channels 64 of an adjacent slip-resistant tile 50 at a seam 88, thereby enabling liquid and/or debris to be removed from a site of a spill by flowing from a channel 64 of one slip-resistant tile 50 into an abutting channel 64 of an adjacent slip-resistant tile 50.

Figure 6A:
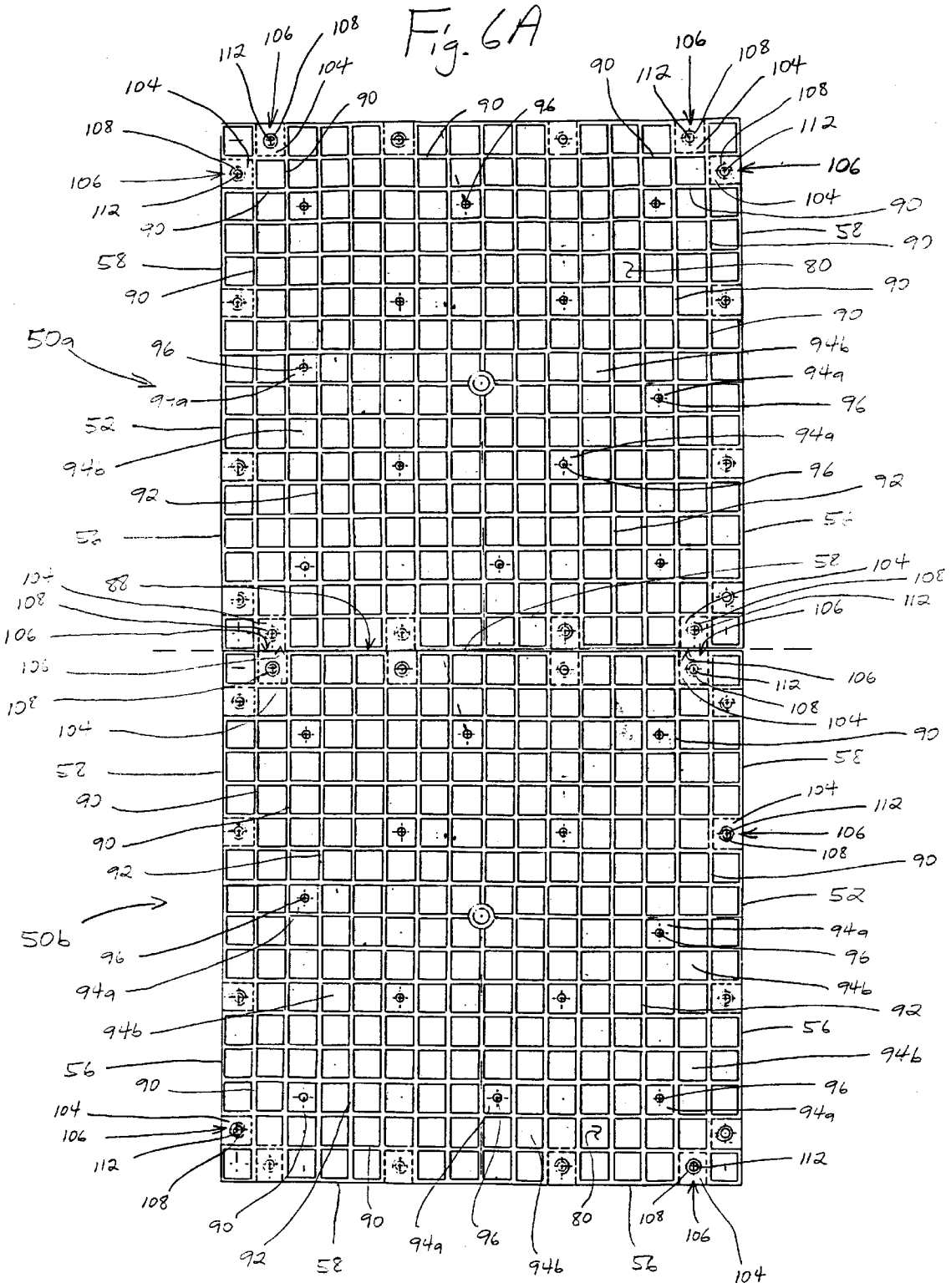
FIG. 6A is a partial, bottom, plan view of the assembly of slip-resistant tiles of FIG. 5.

FIG. 6A shows a partial, bottom, plan view of a portion of assembly 86, in accordance with the first preferred embodiment of the present invention, comprising adjacent slip-resistant tiles 50*a,b* prior to being coupled to form a part of assembly 86. A portion of the lower surface 80 of the base 52 of each slip-resistant tile 50 defines a plurality of ribs 90 extending between opposing sides 56 of the tile 50 and being arranged in a row and column grid 92. Other portions of the lower surface 80 extend between some adjacent ribs 90 of the row and column grid 92 of ribs to define a first plurality of recesses 94*a* and a second plurality of recesses 94*b* (see also FIG. 6B). The ribs 90 and portions of the lower surface 80 defining a recess 94 of the first and second pluralities of recesses 94*a*,94*b* do not, generally, come into contact with a floor surface when the slip-resistant tile 50 is positioned atop a floor. Protruding members 96 depend from the portions of the lower surface 80 which define the recesses 94*a* of the first plurality of recesses 94*a* (see also FIGS. 7A and 7B). No protruding members 96 depend from the portions of the lower surface 80 which define the recesses 94*b* of the second plurality of recesses 94*b*. Each protruding member 96 has a first portion 98 depending from the lower surface 80 and a second portion 100 disposed from the lower surface 80 by the first portion 98. The second portion 100 of each protruding member 96 extends beyond the portion of the lower surface 80 which defines the plurality of ribs 90 of the grid 92 and, typically, contacts a floor surface when the slip-resistant tile 50 is placed atop a floor to limit movement of the tile 50 relative to the floor surface. Note that protruding members 96 are strategically positioned at various locations relative to the sides 56 of the slip-resistant tile 50 to enhance their tile movement-limiting capability. Note also that, preferably, the first portion 98 of each protruding member 96 has a circular cross-section and the second portion 100 of each protruding member 96 defines a, generally, conical-shaped surface 102.

Figure 6B:
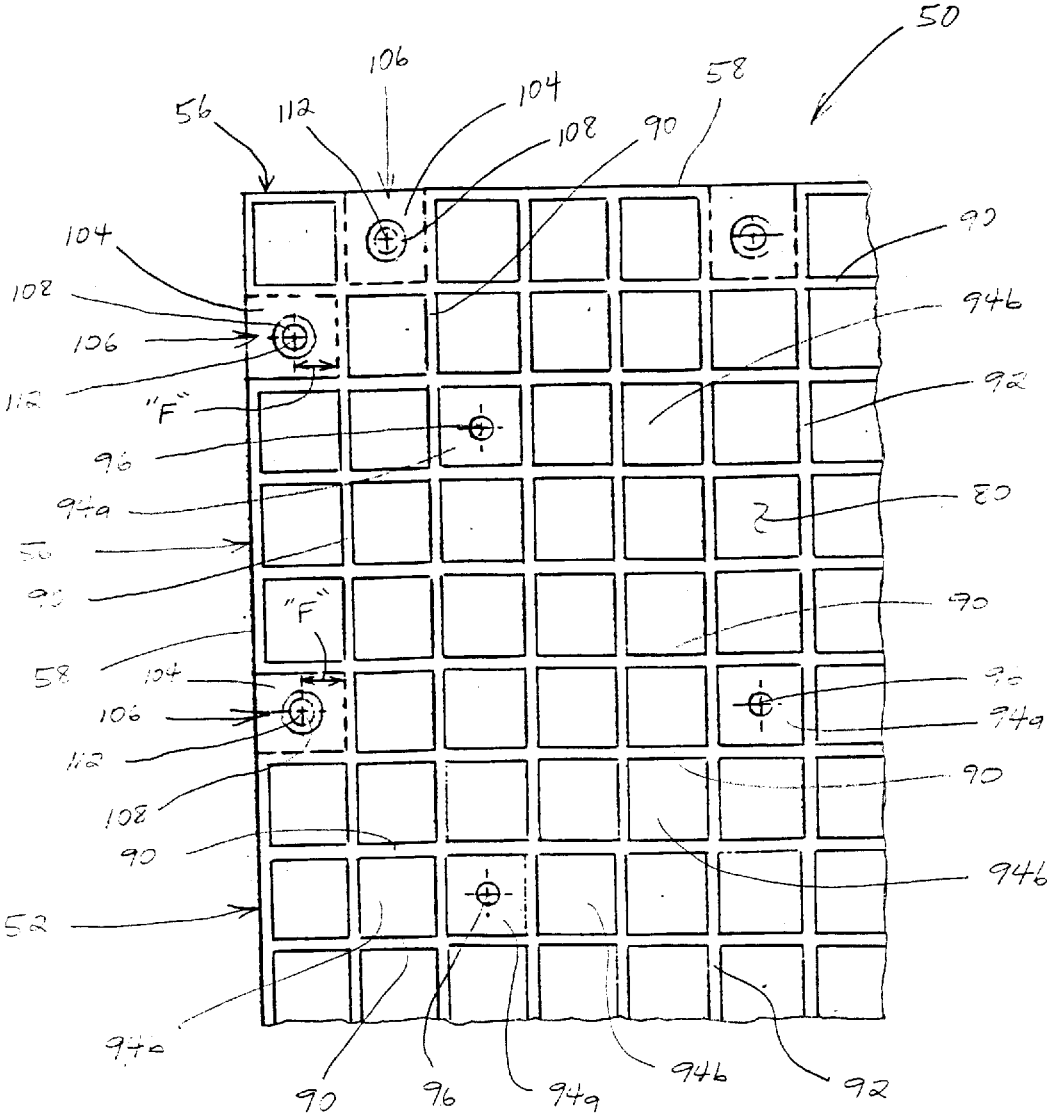
FIG. 6B is a partial, bottom, plan view of a slip-resistant tile of the assembly of slip-resistant tiles of FIG 5.
Figure 7B:
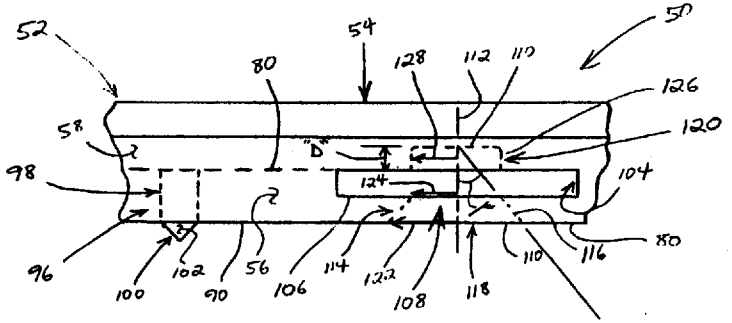
FIG. 7B is a partial, side elevational view of the slip-resistant tile of FIG. 7A.
Figure 7A:
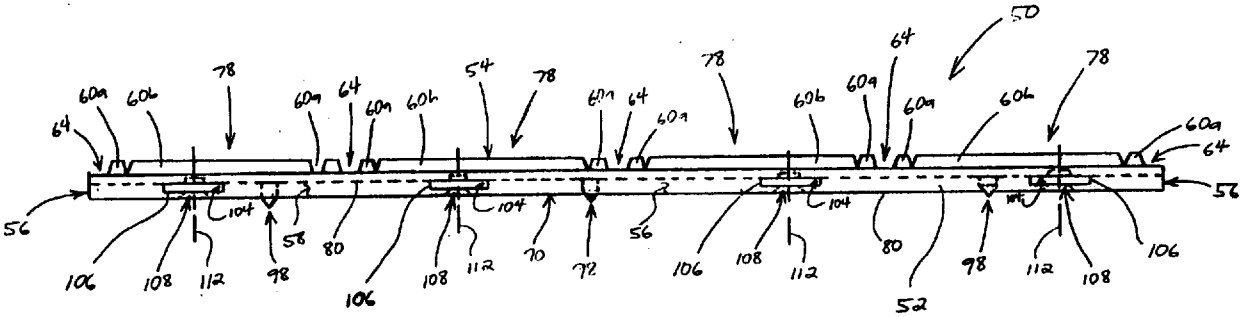
FIG. 7A is a side elevational view of the slip-resistant tile of FIG. 1.

The base 52 of each slip-resistant tile 50, as seen in FIGS. 6A and 6B, defines a plurality of cavities 104 extending between a side 56 of the tile 50 and adjacent ribs 90 of the lower surface 80 of the tile 50. The base 52 further defines a passageway 106 to each cavity 104 of the plurality of cavities 104 through the respective side 56 of the tile 50 (see also FIGS. 7A and 7B). Preferably, the passageway 106 associated with each cavity 104 has a, generally, rectangular shape. The base 52 additionally defines a plurality of bores 108 having ends 110 and central axes 112 extending therethrough. Each bore 108 of the plurality of bores 108 extends through an associated cavity 104 of the plurality of cavities 104 and has a first portion 114 defined by a surface 116 which extends about a central axis 112 between an opening 118, defined at a first end 110 of the bore 108 by the lower surface 80 of the base 52, and the bore's associated cavity 104. The surface 116 and central axis 112 define a radius 122 at opening 118 and a radius 124 at the location where the first portion 114 of the bore 108 and its associated cavity 104 meet. The surface 116 also forms an angle, $\mu$, with central axis 112 which, preferably, measures forty-five degrees, thereby defining a bore 108 which tapers (i.e., the measure of radius 122 is greater than the measure of radius 124) between the opening 118 and the location where the first portion 114 of the bore 108 meets the associated cavity 104. Note that the portions of the lower surface 80 about the openings 118 of the plurality of openings 118 are, preferably, flush with the lowermost surfaces of the ribs 90 of the plurality of ribs 90.

In accordance with the first preferred embodiment of the apparatus of the present invention, the second portion 120 of each bore 108 of the plurality of bores 108 is defined by a surface 126 extending radially about the central axis 112 from the bore's associated cavity 104 for a distance, "D", toward the upper surface 54 of the base 52. The distance, "D", is selected to receive a portion of a pin 156, as described below, sufficient to enable the pin 156 and base 52 to withstand forces tending to separate joined tiles 50. The surface 126 and central axis 112 define a radius 128 which, preferably, has a measure equal to the measure of radius 124 of the first portion 114 of the bore 108.

Figure 8A:
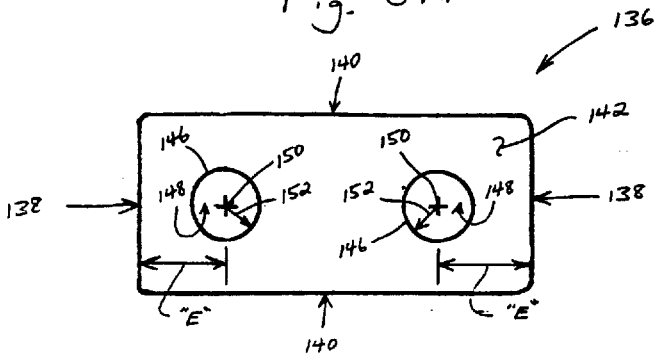
FIG. 8A is a top, plan view of a clip of the assembly of slip-resistant tiles of FIG. 5.
Figure 8B:
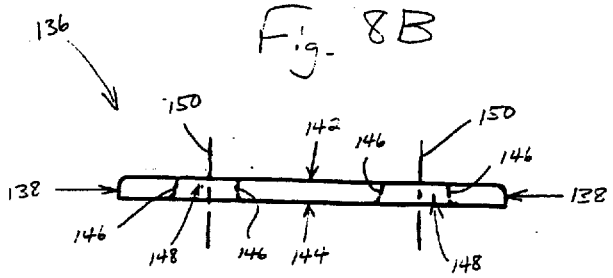
FIG. 8B is elevational view of the clip of FIG. 8A.

FIGS. 8A and 8B display a clip 136, in accordance with the first preferred embodiment of the apparatus of the present invention, having ends 138, sides 140, and upper and lower surfaces 142,144, respectively. The clip 136 has surfaces 146 which define holes 148 extending between the upper and lower surfaces 142,144 about central axes 150. Radii 152, having equal measure, extend between the central axes 150 of holes 148 and corresponding surfaces 146. Holes 148 are located at a distance, "E", measured between the central axes 150 of the holes 148 and a respective nearest clip end 138. Note that, preferably, the measure of radii 152 equal the measure of radius 128 of the second portion 120 of a bore 108. Note also that, preferably, distance, "E", equals a distance, "F", defined between the central axis 112 of a bore 108 and an end 154 of an associated cavity 104 so that the central axis 112 of a bore 108 and a central axis 150 of a hole 148 of a clip 136 received by the bore's associated cavity 104 are collinear after assembly as described below.

Figure 9A:
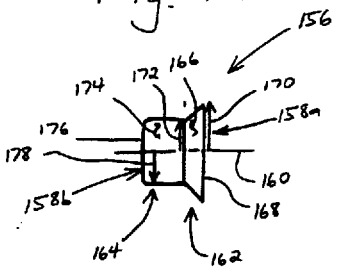
FIG. 9A is a side elevational view of a pin in accordance with the first preferred embodiment of the apparatus of the present invention.
Figure 9B:
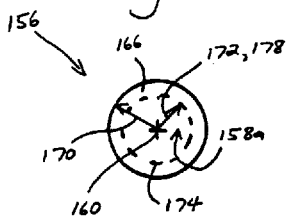
FIG. 9B is an end elevational view of the pin of FIG. 9A

A pin 156, which cooperates with a bore 108, a cavity 104 associated with the bore 108, and a hole 148 of a clip 136 upon assembly, is shown in FIGS. 9A and 9B. The pin 156, in accordance with the first preferred embodiment of the present invention, has ends 158 and defines a central axis 160 extending between the ends 158. The pin 156 includes a first portion 162 extending from, and including, end 158*a* and a second portion 164 extending from, and including, end 158*b*. The first portion 162 comprises a lateral surface 166 and an end surface 168, located at end 158*a*. The lateral surface 166 defines a first radius 170 about central axis 160 at end 158*a* and a second radius 172 about central axis 160 at a location where the first portion 162 meets the second portion 164. Preferably, the measure of radius 170 is greater than the measure of radius 172, thereby causing lateral surface 166 to taper about the central axis 160 of the pin 156 between end 158*a* and the location where the first portion 162 meets the second portion 164. Note that, radii 170,172 measure slightly less than respective radii 122,124 of a bore 108 of the plurality of bores 108 so that, upon assembly as described below, the first portion 162 of a pin 156 resides within the first portion 114 of a bore 108, lateral surface 166 is adjacent surface 116 of the bore 108, and end surface 168 is flush with the lower surface 80 of the base 52 in the area around the bore's opening 118. The second portion 164 of pin 156 comprises a lateral surface 174 and an end surface 176, located at end 158*b*. The lateral surface 174 extends between the location where the first portion 162 meets the second portion 164 and end 158*b*, and defines a radius 178 about central axis 160. Preferably, the measure of radius 178 is slightly less than the measure of radius 128 of the second portion 120 of a bore 108 so that parts of lateral surface 174 are adjacent bore surface 126 and surface 146 of a clip 136 when the second portion 164 of pin 156 resides within the second portion 120 of a bore 108 after assembly as described below. It is understood that the scope of the present invention includes all other apparatus which may be employed to connect adjacent slip-resistant tiles together.

In accordance with a first preferred embodiment of a method of the present invention, a plurality of slip-resistant tiles 50 are received in a desired arrangement by a sturdy flat surface with the tiles' upper surfaces 54 contacting the flat surface as shown in FIG. 10A. The tiles 50 of the plurality of slip-resistant tiles 50 are received with outside edges 58 (denoted in FIG. 10A by a subscript "o") positioned around the periphery, or perimeter, of the arrangement and with inside edges 58 (denoted in FIG. 10A by a subscript "i") abutting inside edges 58 of adjacent slip-resistant tiles 50 to define a seam 88 between adjacent slip-resistant tiles 50. At a seam 88, adjacent tiles 50 are aligned so that a number of passageways 106 of one tile 50 oppose a similar number of passageways 106 of a second tile 50 (and, hence, a number of cavities 104 of one tile 50 oppose a similar number of cavities 104 of a second tile 50). After temporarily spreading apart adjacent tiles 50*a,b*, for example and as illustrated in FIG. 10B, a first end 138*a* of a clip 136 is then received by passageway 106*a* of tile 50*a* and a second end 138*b* of the clip 136 is received by passageway 106*b* of tile 50*b*. Upon similar receipt of ends 138 of other clips 136 by other passageways 106*a,b* of the adjacent tiles 50*a,b*, the tiles 50*a,b* are re-positioned, as displayed by the orientation shown in FIG. 10C, to abut appropriate edges 58 of the tiles 50*a,b* and redefine a seam 88 between the adjacent slip-resistant tiles 50a,b. In this orientation, a portion of each clip 136 extends through opposed passageways 106*a,b* and within opposed cavities 104*a,b* of the adjacent tiles 50*a,b* to collinearly align the central axes 112*a,b* of the bores 108*a,b* with the respective central axes 150*a,b* of clip holes 148*a,b*. Then, as shown in FIG. 10C, pins 156*a,b* are received (i.e., in response to tapping by a hammer) by bores 108*a,b* and by clip holes 148*a,b* to collinearly align each pin central axis 160 with the central axes 112*a,b* of bores 108*a,b* and with the central axes 150*a,b* of the associated clip holes 148*a,b*. Once received, sections of the lateral surfaces 166*a,b*, 174*a,b* of the pins 156*a,b* reside adjacent surfaces 116*a,b*, 126*a,b* of the first and second portions 114*a,b*,120*a,b* of the respective bores 108*a,b* of the tiles 50*a,b* and a section of the lateral surfaces 174*a,b* of the pins 156*a,b* also resides adjacent surfaces 146*a,b* of clip holes 148*a,b*. A plurality of clips 136 and pins 156 are then received, according to a substantially similar process, by other cavities 104*a,b* and bores 108*a,b* of the adjacent slip-resistant tiles 50*a,b* until the tiles 50*a,b* are sufficiently joined together. Other adjacent slip-resistant tiles 50 are also joined in a substantially similar manner to form an assembly 86 of slip-resistant tiles 50 (see FIG. 5) having an area sufficient to cover a hazardous region of floor surface.

Figure 11:
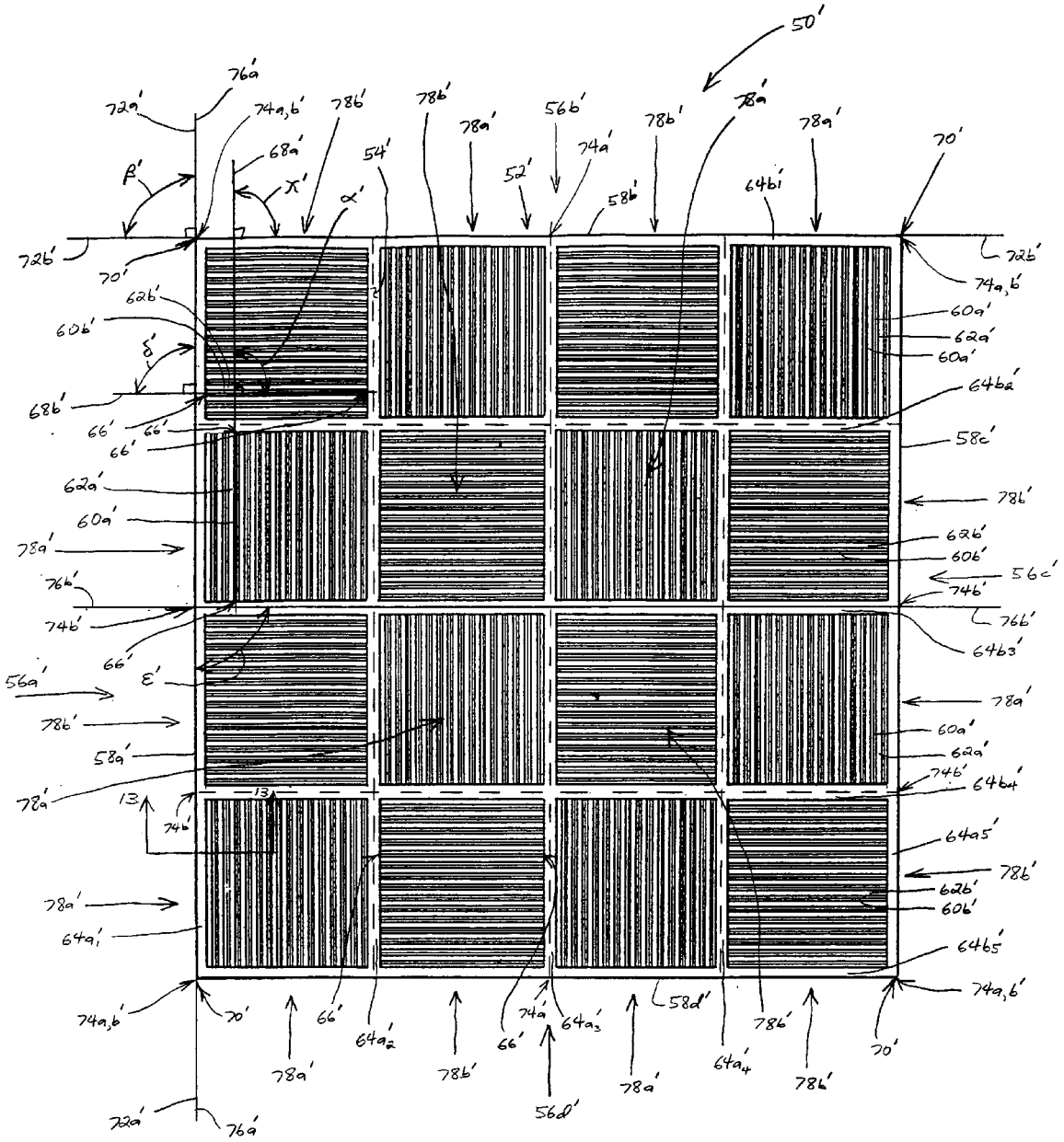
FIG. 11 is a top, plan view of a slip-resistant tile in accordance with a second preferred embodiment of an apparatus of the present invention.
Figure 12A:
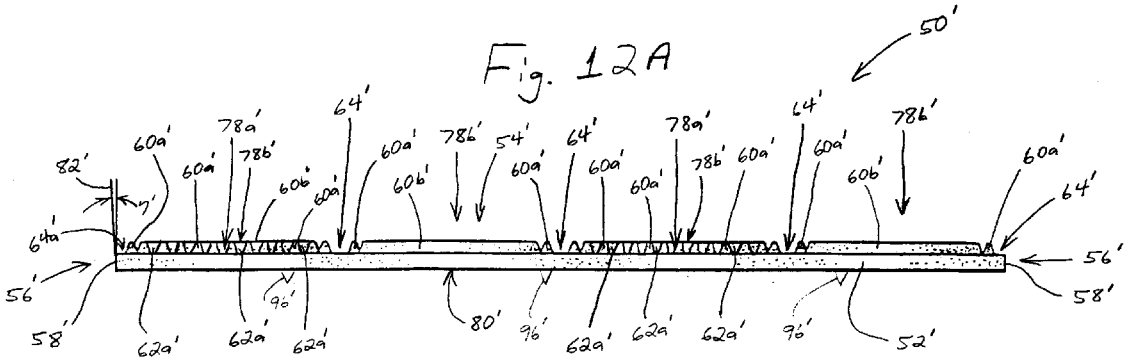
FIG. 12A is a side elevational view of the slip-resistant tile of FIG. 11.
Figure 12B:
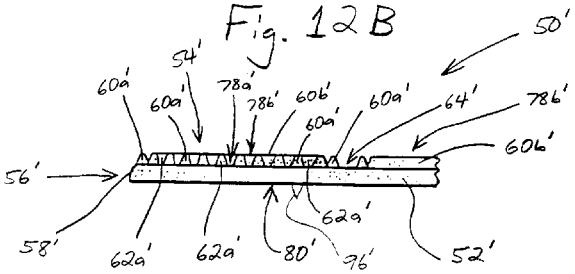
FIG. 12B is a partial, side elevational view of a slip-resistant tile having a beveled edge in accordance with the second preferred embodiment of the apparatus of the present invention.
Figure 13:
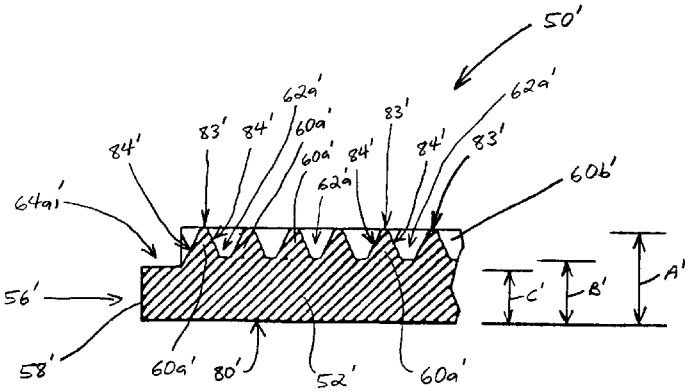
FIG. 13 is a partial, sectional view of the slip-resistant tile of FIG. 11 taken along lines 13—13.
Figure 14:
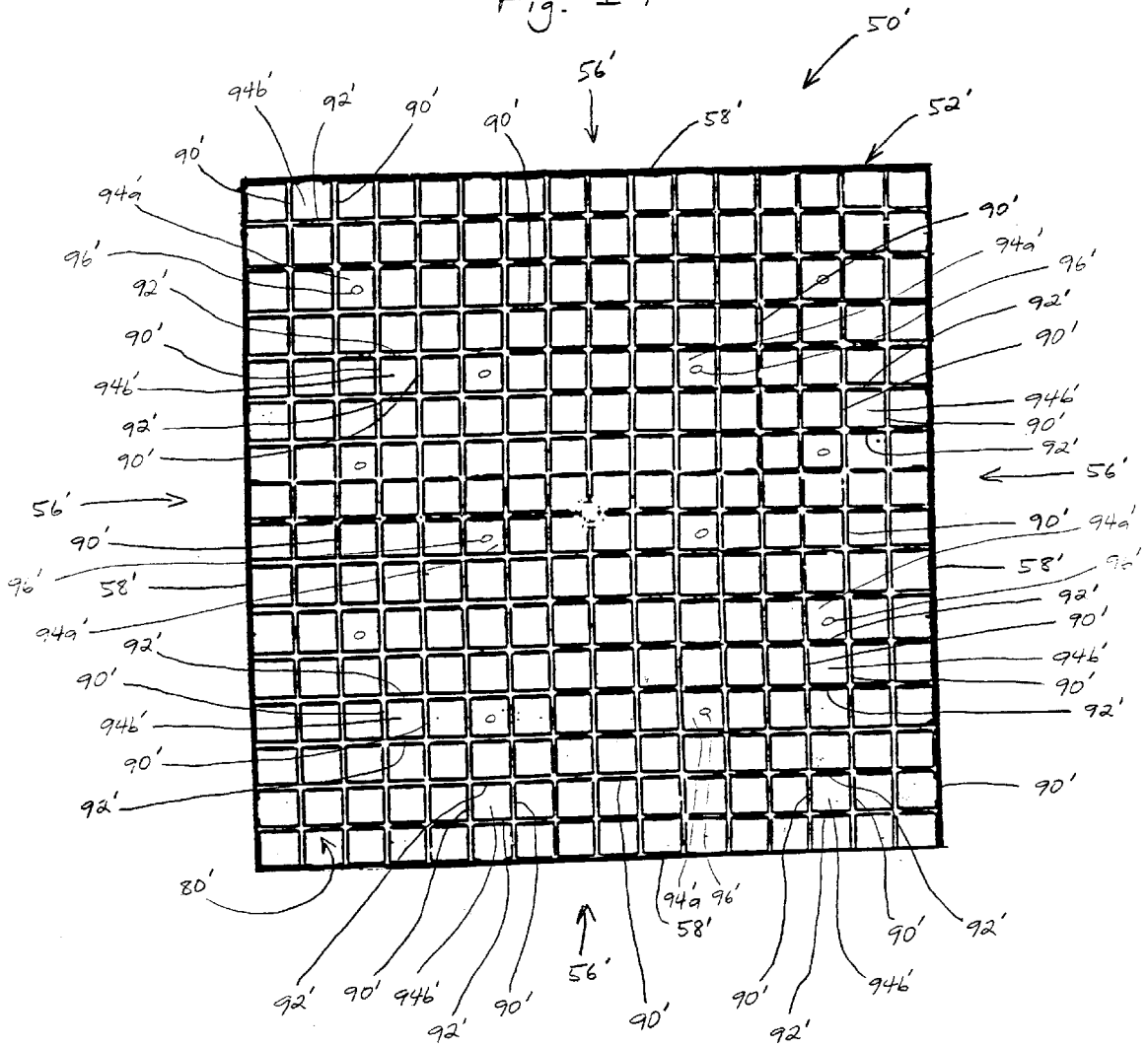
FIG. 14 is a bottom, plan view of the slip-resistant tile of FIG. 11.

FIGS. 11–14 display various views of a slip-resistant tile 50' in accordance with a second preferred embodiment of an apparatus of the present invention which is substantially similar to the first preferred embodiment of the apparatus of the present invention with certain differences as noted herein. As shown in FIG. 11, the plurality of channels 64' comprises only a first plurality of channels 64*a'* and a second plurality of channels 64*b'* (i.e., the third and fourth pluralities of channels 64*c,d* of the first embodiment are not present in the second embodiment). Each ridge 60*a'* of the first plurality of ridges 60*a'* extends between channels 64*b'* of the second plurality of channels 64*b'* and each trough 62*a'* of the first plurality of troughs 62*a*' is in fluid communication with two channels 64*b*' of the second plurality of channels 64*b*'. Each ridge 60*b*' of the second plurality of ridges 60*b*' extends between channels 64*a*' of the first plurality of channels 64*a*' and each trough 62*b*' of the second plurality of troughs 62*b*' is in fluid communication with two channels 64*a*' of the first plurality of channels 64*a*'. The plurality of cells 78', as illustrated in FIG. 11, includes a first plurality of cells 78*a*' and a second plurality of cells 78*b*'. The first plurality of cells 78*a*' comprises ridges 60*a*' of the first plurality of ridges 60*a*' and the second plurality of cells 78*b*' comprises ridges 60*b*' of the second plurality of ridges 60*b*'. Note that each cell 78*a*' of the first plurality of cells 78*a*' is adjacent at least two cells 78*b*' of the second plurality of cells 78*b*' and that each cell 78*b*' of the second plurality of cells 78*b*' is adjacent at least two cells 78*a*' of the first plurality of cells 78*a*'. The base 52' of a slip-resistant tile 50', in accordance with the second preferred embodiment of the present invention, is shown in FIG. 14. The base 52' has a lower surface 80' which defines a plurality of ribs 90', arranged in a row and column grid 92', and a plurality of recesses 94', defined by adjacent ribs 90' of the row and column grid 92'. Note that the base 52' and its lower surface 80' do not define cavities, bores, and passageways and, therefore, the slip-resistant tile 50' is not joinable, using clips and pins, to adjacent slip-resistant tiles 50' in order to form an assembly of slip-resistant tiles 50' similar to the assembly 86 of the first preferred embodiment.

FIGS. 15–18 display a slip-resistant tile 50" in accordance with a third preferred embodiment of the present invention which is substantially similar to the first preferred embodiment of the apparatus of the present invention with certain differences as noted herein. As pictured in FIG. 15, the plurality of channels 64" comprises only a first plurality of channels 64*a*" and a second plurality of channels 64*b*". Each ridge 60" of the plurality of ridges 60" extends between a channel 64*a*" of the first plurality of channels 64*a*" and a channel 64*b*" of the second plurality of channels 64*b*". Each trough 62" of the plurality of troughs 62" is in fluid communication with a channel 64*a*" of the first plurality of channels 64*a*" and a channel 64*b*" of the second plurality of channels 64*b*". Note also that each ridge 60*a*" of the first plurality of ridges 60*a*" defines an angle, $\chi$", measuring forty-five degrees and each ridge 60*b*" of the second plurality of ridges 60*b*" defines an angle, $\delta$", also measuring forty-five degrees.

Figure 15:
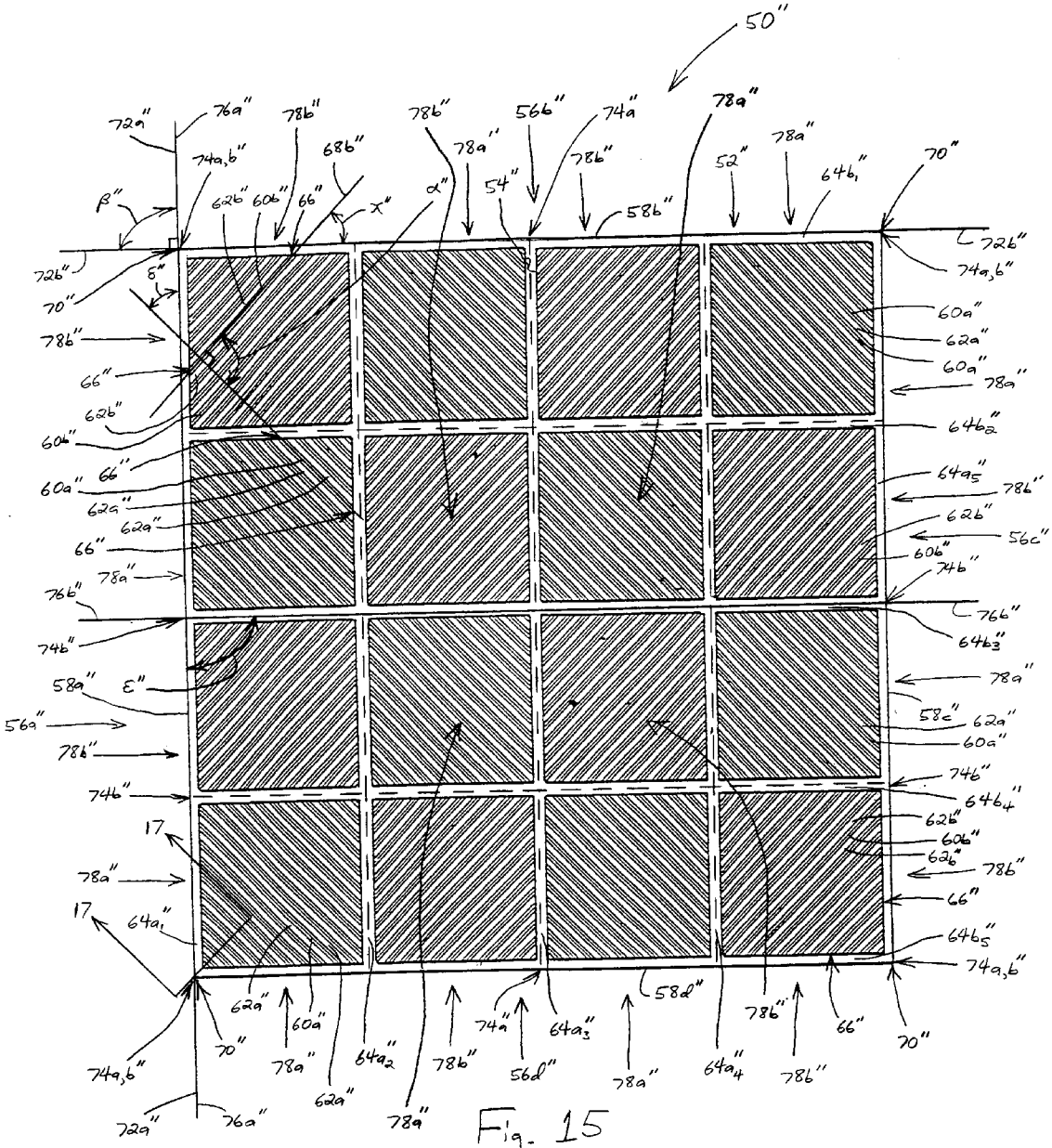
FIG. 15 is a top, plan view of a slip-resistant tile in accordance with a third preferred embodiment of an apparatus of the present invention.
Figure 18:
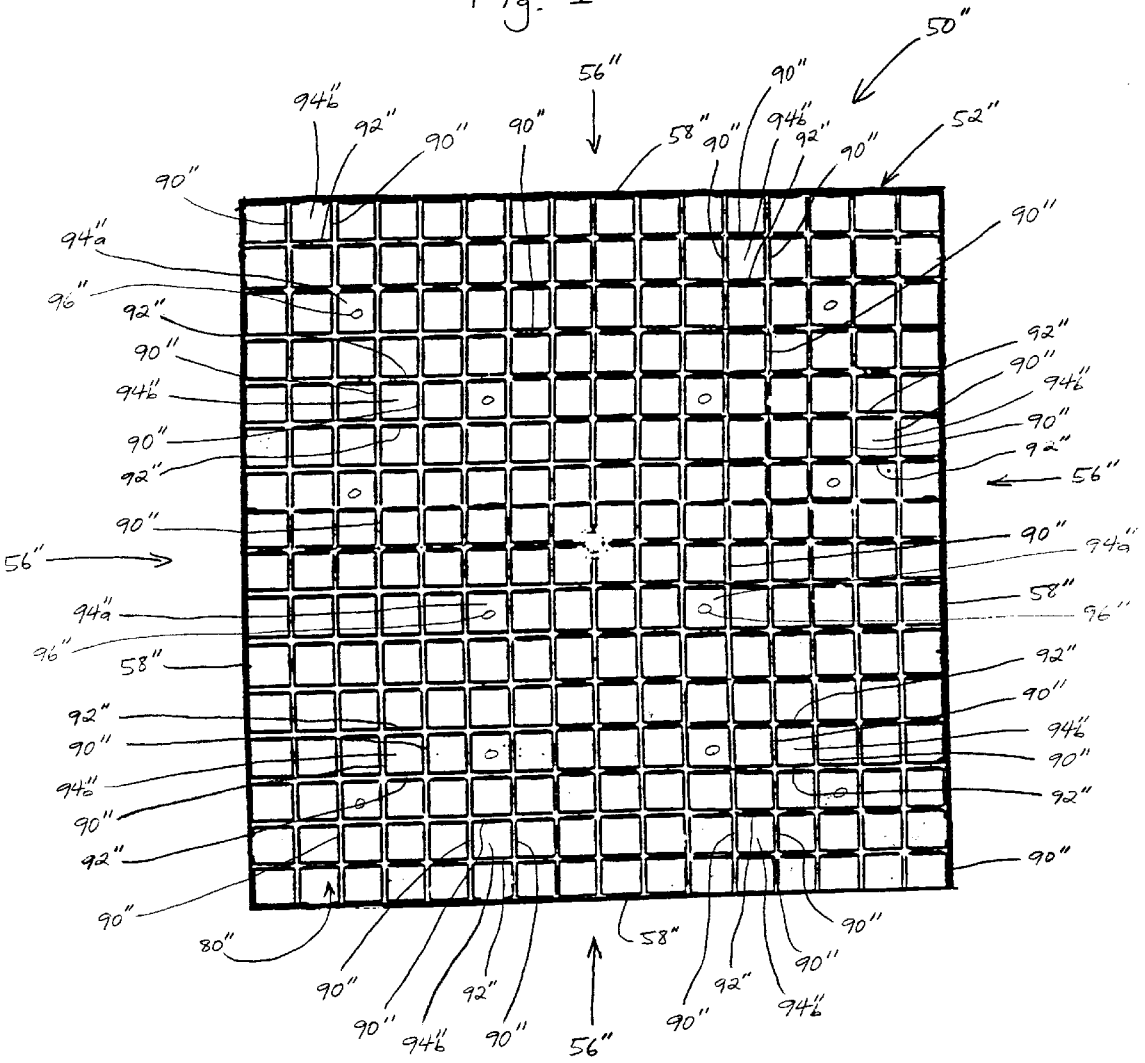
FIG. 18 is a bottom, plan view of the slip-resistant tile of FIG. 15.
Figure 19:
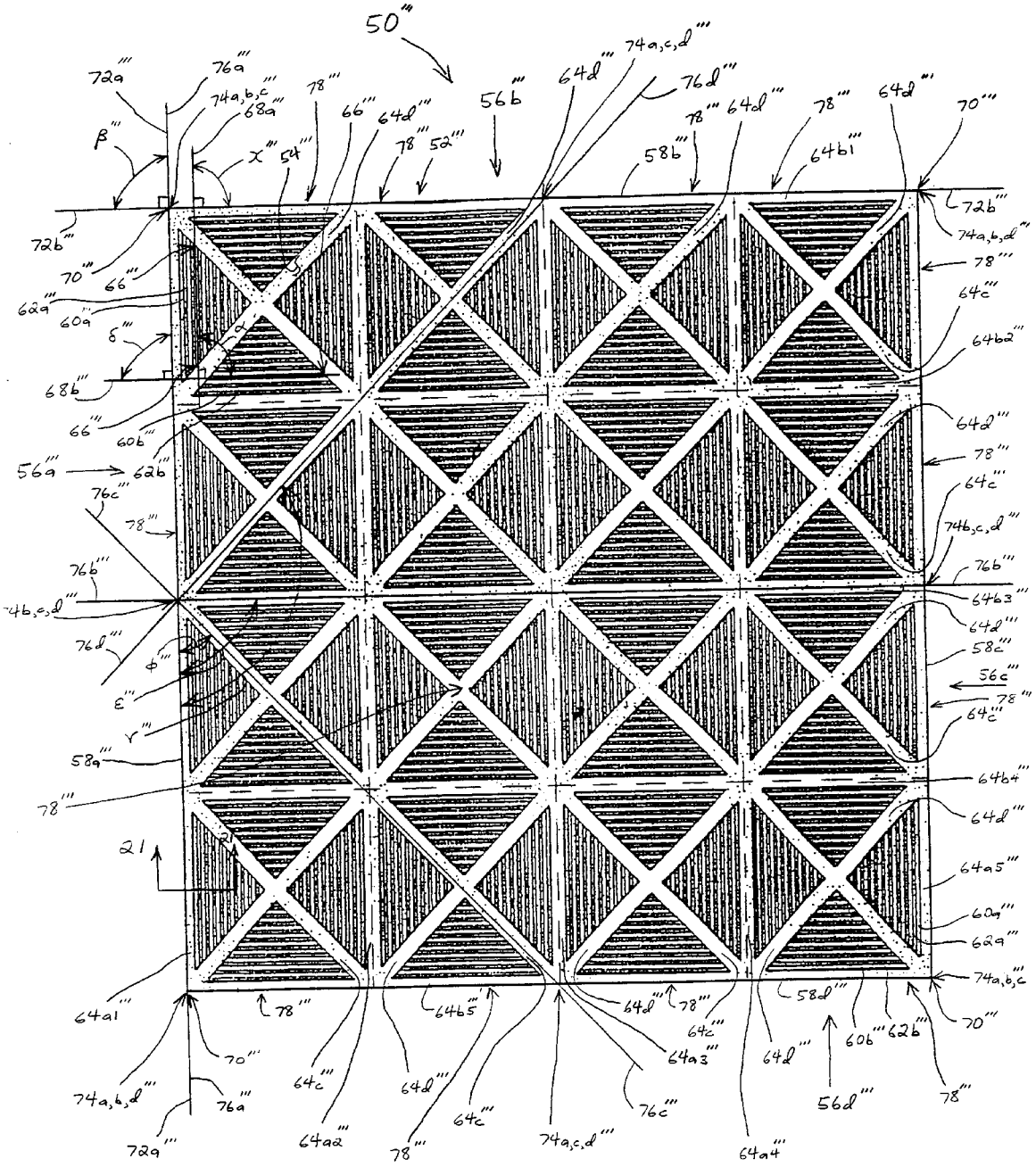
FIG. 19 is a top, plan view of a slip-resistant tile in accordance with a fourth preferred embodiment of an apparatus of the present invention.
Figure 20A:
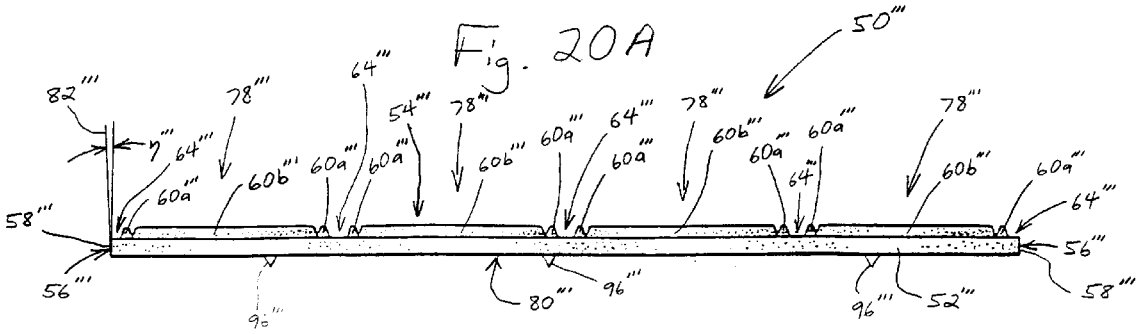
FIG. 20A is a slide elevational view of the slip-resistant tile of FIG. 19.
Figure 20B:
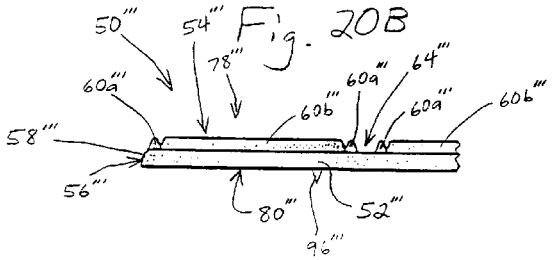
FIG. 20B is a partial, side elevational view of a slip-resistant tile having a beveled edge in accordance with the fourth preferred embodiment of the apparatus of the present invention.
Figure 21:
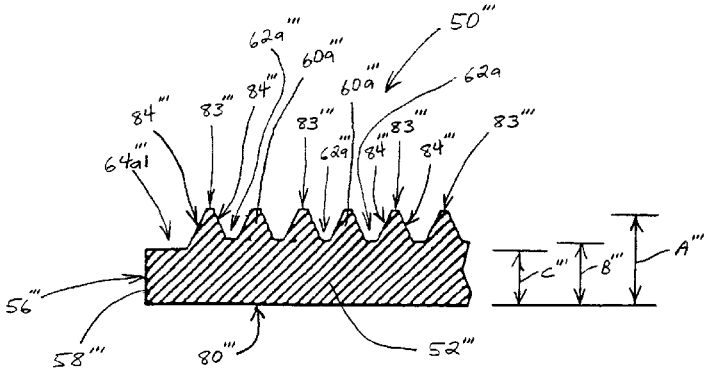
FIG. 21 is a partial, sectional view of the slip-resistant tile of FIG. 19 taken along lines 21—21.
Figure 22:
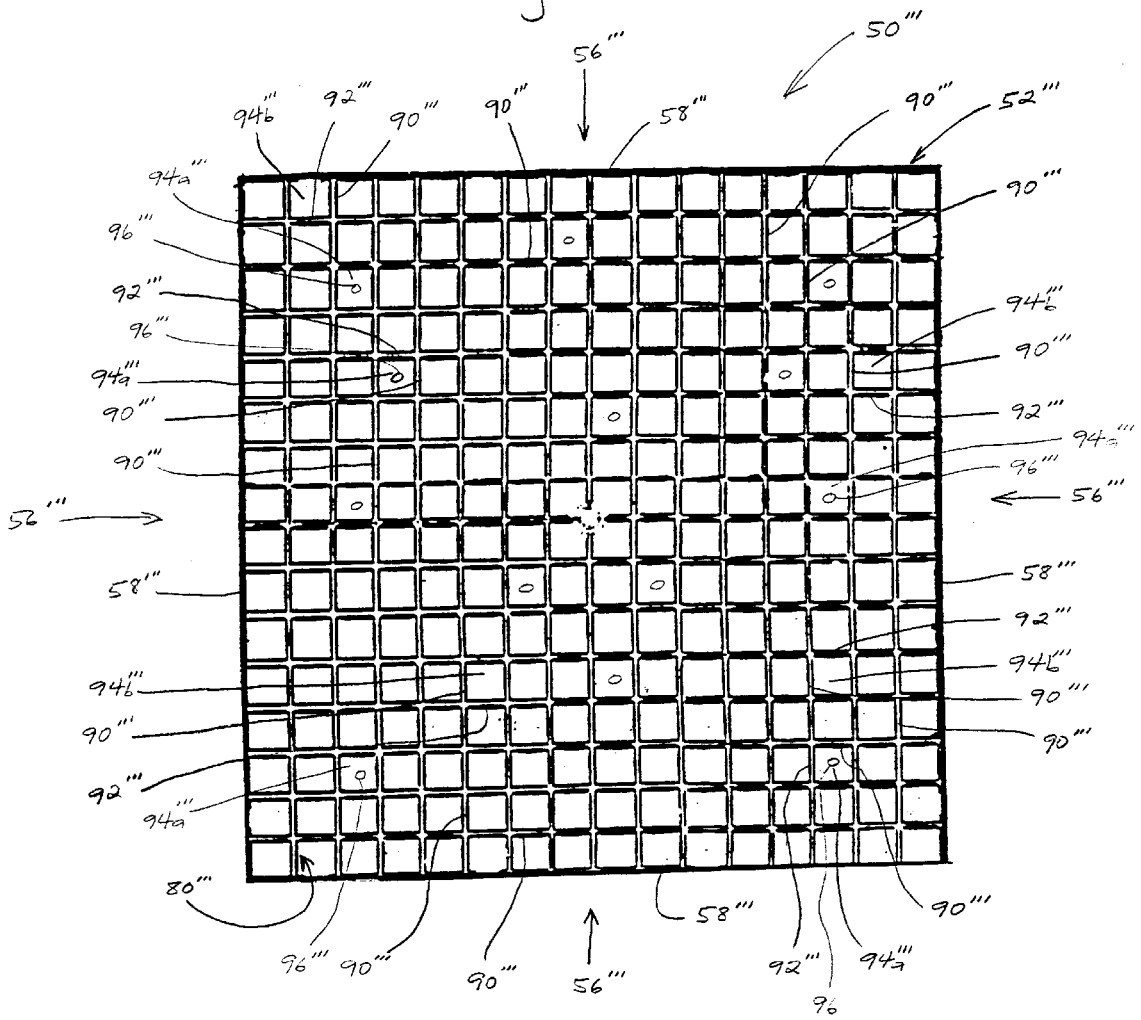
FIG. 22 is a bottom, plan view of the slip-resistant tile of FIG. 19.

The plurality of cells 78", as illustrated in FIG. 15, includes a first plurality of cells 78*a*" and a second plurality of cells 78*b*". The first plurality of cells 78*a*" comprises ridges 60*a*" of the first plurality of ridges 60*a*"(and the troughs 62*a*" of the associated first plurality of troughs 62*a*") and the second plurality of cells 78*b*" comprises ridges 60*b*" of the second plurality of ridges 60*b*"(and the troughs 62*b*" of the associated second plurality of troughs 62*b*"). Note that each cell 78*a*" of the first plurality of cells 78*a*" is adjacent at least two cells 78*b*" of the second plurality of cells 78*b*" and that each cell 78*b*" of the second plurality of cells 78*b*" is adjacent at least two cells 78*a*" of the first plurality of cells 78*a*". Note also that the base 52" and its lower surface 80" do not define cavities, bores, and passageways and, therefore, the slip-resistant tile 50" is not joinable, using clips and pins, to adjacent slip-resistant tiles 50" in order to form an assembly of slip-resistant tiles 50" similar to the assembly 86 of the first preferred embodiment.

FIGS. 19–22 depict a slip-resistant tile 50'" in accordance with a fourth preferred embodiment of an apparatus of the present invention. Note that the slip-resistant tile 50'" of the fourth preferred embodiment is substantially similar to the slip-resistant tile 50 of the first preferred embodiment except that the lower surface 80'" and the base 52'" do not define cavities, bores, and passageways and, therefore, the slip-resistant tile 50'" is not connectable, using clips and pins, to adjacent slip-resistant tiles 50'" in order to form an assembly of slip-resistant tiles 50'" similar to the assembly 86 of the first preferred embodiment.

Whereas this invention has been described in detail with particular reference to its most preferred embodiments, it is understood that variations and modifications can be effected within the spirit and scope of the invention, as described herein before and as defined in the appended claims.

I claim:

1. A floor covering, comprising:

a plurality of tiles, wherein each tile of said plurality of tiles abuts and is securable to an adjacent tile of said plurality of tiles, each tile of said plurality of tiles including a base having a first surface and a second surface disposed below said first surface, said base defining a cavity located between said first and second surfaces, a plurality of ridges protruding from said base and partially defining said first surface of said base, and a plurality of troughs partially defining said first surface of said base, wherein adjacent ridges of said plurality of ridges define one of said plurality of troughs;

a clip having one side interacting with a cavity of a first tile of said plurality of tiles and having another side interacting with a cavity of a second tile of said plurality of tiles adjacent said first to said clip being secured to said first tile and said second tile; and a pin interacting with said clip and said first tile of said plurality of tiles whereby the clip is secured to the first tile of the plurality of tiles, and whereby the first tile is coupled to the second tile.

2. The floor covering of claim 1 wherein, said pin is a first pin and said floor covering further includes a second pin, and said second pin interacts with said clip and said second tile of said plurality of tiles, whereby the clip is secured to the second tile of the plurality of tiles.

3. The floor covering of claim 1, wherein said clip and said pin are received by said cavity of said first tile of said plurality of tiles.

4. The floor covering of claim 1 wherein, said base of said first tile further defines a bore therein and an axis of said bore, said clip defines a bore therethrough and an axis of said bore, and said axis of said bore of said base and said axis of said bore of said clip are in alignment.

5. The floor covering of claim 4 wherein, said pin defines an axis therethrough, said pin extends within said bore of said clip and within said bore of said base of said first tile, and said axis of said pin and said axis of said bore of said clip and said axis of said bore of said base of said first tile are in alignment.

6. The floor covering of claim 4 wherein, a portion of said bore of said base of said first tile extends from said cavity of said base toward said first surface of said base, and said pin extends within said portion of said bore.

7. A method of joining a plurality of floor covering tiles, said each tile including:

a base having a first surface and a second surface disposed below said first surface, said base defining a cavity located between said first and second surfaces, a plurality of ridges protruding from said base and partially defining said first surface of said base, a plurality of troughs partially defining said first surface of said base, wherein adjacent ridges of said plurality of ridges define one of said plurality of troughs; and the method comprising the steps of:

receiving a clip in a cavity of a first tile of the plurality of floor covering tiles and in a cavity of a second tile of the plurality of floor covering tiles adjacent said first tile, the clop having bores on two sides; and securing the clip to the first and second tiles of the plurality of floor covering tiles by pins respectively;

wherein the step of receiving includes a step of receiving the clip within a base of each of the first and second tiles of the plurality of floor covering tiles and in alignment with a bore of the first tile of the plurality of floor covering tiles and in alignment with a bore of the second tile of the plurality of floor covering tiles with the bores of the clip, whereby the first tile is joined to the second tile.

8. A method of joining a plurality of floor covering tiles, said each tile including:

a base having a first surface and a second surface disposed below said first surface, said base defining a cavity located between said first and second surfaces, a plurality of ridges protruding from said base and partially defining said first surface of said base, a plurality of troughs partially defining said first surface of said base, wherein adjacent ridges of said plurality of ridges define one of said plurality of troughs; and the method comprising the steps of:

receiving a clip in a cavity of a first tile of the plurality of floor covering tiles and in a cavity of a second tile of the plurality of floor covering tiles; and securing the clip to the first and second tiles of the plurality of floor covering tiles;

wherein the step of securing includes a step of receiving a pin within a bore defined by the clip and interacting with at least one of the first tile and the second tile, whereby the first tile is joined to the second tile.

9. A method of joining a plurality of floor covering tiles, said each tile including:

a base having a first surface and a second surface disposed below said first surface, said base defining a cavity located between said first and second surfaces, a plurality of ridges protruding from said base and partially defining said first surface of said base, a plurality of troughs partially defining said first surface of said base, wherein adjacent ridges of said plurality of ridges define one of said plurality of troughs; and the method comprising the steps of:

receiving a clip in a cavity of a first tile of the plurality of floor covering tiles and in a cavity of a second tile of the plurality of floor covering tiles; and securing the clip to the first and second tiles of the plurality of floor covering tiles;

wherein the step of securing includes a step of receiving a first pin within a bore defined by the first tile of the plurality of floor covering tiles and interacting with the clip; and receiving a pin second within a bore defined by the second tile of the plurality of floor covering tiles and interacting with the clip;

whereby the first tile is joined to the second tile.

10. The method of claim 9, wherein the step of securing further includes the steps of receiving the first pin within a first bore defined by the clip and within the bore defined by the first tile of the plurality of floor covering tiles, and receiving the second pin within a second bore defined by the clip and within the bore defined by the second tile of the plurality of floor covering tiles.

11. The method of claim 10 wherein, the first bore defined by the clip and the bore defined by the first tile of the plurality of floor covering tiles are in alignment, and the second bore defined by the clip and the bore defined by the second tile of the plurality of floor covering tiles are in alignment.

12. A method of joining a plurality of floor covering tiles, said each tile including:

a base having a first surface and a second surface disposed below said first surface, said base defining a cavity located between said first and second surfaces, a plurality of ridges protruding from said base and partially defining said first surface of said base, a plurality of troughs partially defining said first surface of said base, wherein adjacent ridges of said plurality of ridges define one of said plurality of troughs; and the method comprising the steps of:

receiving a clip in a cavity of a first tile of the plurality of floor covering tiles and in a cavity of a second tile of the plurality of floor covering tiles adjacent the first tile; and securing the clip to the first and second tiles of the plurality of floor covering tiles;

wherein the step of securing includes the step of receiving a pin interacting the first tile and the clip, and receiving a pin interacting the second tile and the clip, whereby the first tile is joined to the second tile.

* * * * *